US007143970B2

(12) United States Patent
Ha

(10) Patent No.: US 7,143,970 B2
(45) Date of Patent: Dec. 5, 2006

(54) JAW CRUSHER

(76) Inventor: Yonggan Ha, 11318 159B Street, Surrey, British Columbia (CA) V4N 1R6

( * ) Notice: Subject to any disclaimer, the term of this patent is extended or adjusted under 35 U.S.C. 154(b) by 0 days.

(21) Appl. No.: 10/337,813

(22) Filed: Jan. 6, 2003

(65) Prior Publication Data

US 2004/0129814 A1 Jul. 8, 2004

(51) Int. Cl.
*B02C 1/02* (2006.01)
*B02C 1/04* (2006.01)
*B02C 1/06* (2006.01)

(52) U.S. Cl. ..... 241/268; 241/259.1; 241/262; 241/264

(58) Field of Classification Search ..... 241/259.1, 241/264, 268
See application file for complete search history.

(56) References Cited

U.S. PATENT DOCUMENTS 4,361,289 A * 11/1982 Georget et al. ..... 241/32
4,659,026 A * 4/1987 Krause et al. ..... 241/275
4,768,723 A * 9/1988 Fritz ..... 241/268
4,899,942 A * 2/1990 Bohringer ..... 241/200
6,619,576 B1 * 9/2003 Togashi et al. ..... 241/101.74
6,644,577 B1 * 11/2003 Togashi et al. ..... 241/264

* cited by examiner

*Primary Examiner*—Boyer D. Ashley
*Assistant Examiner*—Jason Y Pahng
(74) *Attorney, Agent, or Firm*—Mayer, Brown, Rowe & Maw LLP

(57) ABSTRACT

A jaw crusher used to crush hard materials includes a frame and a fixed and movable jaw positioned in spaced opposed relationship to receive hard materials to be crushed between the jaws. A lever is pivotally connected to the frame for pivotal movement about an axis and includes first and second extensions. The first extension includes a part that is in communication with the movable jaw and a part that is in communication with the axis and the second extension includes a part in communication with a reciprocating drive and a part in communication with the pivot axis. The distance between the parts of the second extension is greater than the distance between the parts of the first extension causing leveraged force to be applied on the movable jaw on application of force on the second extension by the reciprocating drive.

22 Claims, 25 Drawing Sheets

JAW CRUSHER

BACKGROUND OF THE INVENTION

The invention relates to jaw crushers as used in mines or in aggregate producing industries as a primary crusher.

Prior art jaw crushers can be classified into three types, namely single toggle jaw crushers, double toggle jaw crushers, and dodge jaw crushers. Dodge type jaw crushers have very little usage and single toggle jaw crushers are simple in construction and light weight so they have advantages in portable crushing plants. Double toggle jaw crushers are rugged and heavy, so they are usually used in big stationary crushing plants.

Although single toggle jaw crushers are simple in construction and light weight, the eccentric shafts and bearings are located in the upper parts of the crushers and are used to directly apply the significant forces needed to crush heavy aggregate. Particularly with hard materials to be crushed bearings wear is substantial and bearing life is short and as the orbit of a movable jaw is not linear, that is the orbit of the upper part of movable jaw describes a circle and the lower part of a movable jaw describes an elliptical or upwardly slanting line, the wear rate of a jaw liner is high particularly as compared to that of a double toggle jaw crusher. A type of single toggle jaw crusher of the prior art is shown in FIG. 30.

A double toggle jaw crusher has a movable jaw suspended by a large bushing and pin assembly with the movable jaw driven back and forth by a double toggle. The double toggle is connected to a pitman that is powered by an eccentric shaft. In a double toggle jaw crusher, the force required to crush aggregate like large stones is primarily exerted by the bushing pin assembly. As the double toggle acts as a force magnifying device, the force that is exerted on the bearings of the eccentric shaft is small compared to that of a single toggle jaw crusher, generally ⅕ or ⅙ of the force. As a result, the life of the bearings are much longer in a double toggle jaw crusher as compared to the prior art single toggle jaw crushers. In addition, the life of the jaw liners of a double toggle jaw crusher are much longer due to linear movement of the movable jaw.

However, a double toggle jaw crusher is much larger than a single toggle jaw crusher due to the long double toggle and the orientation of the size adjusting mechanism for adjusting the size of crushed stones exiting the crushing chamber. This requires the construction of larger and heavier double toggle jaw crushers which are more costly than a single toggle jaw crusher of equivalent capacity. As a consequence, there is a need for a jaw crusher that has the size, weight and simplicity of construction advantages of single toggle jaw crushers with the durability of a double toggle jaw crusher.

DETAILED DESCRIPTION

Figure 1:
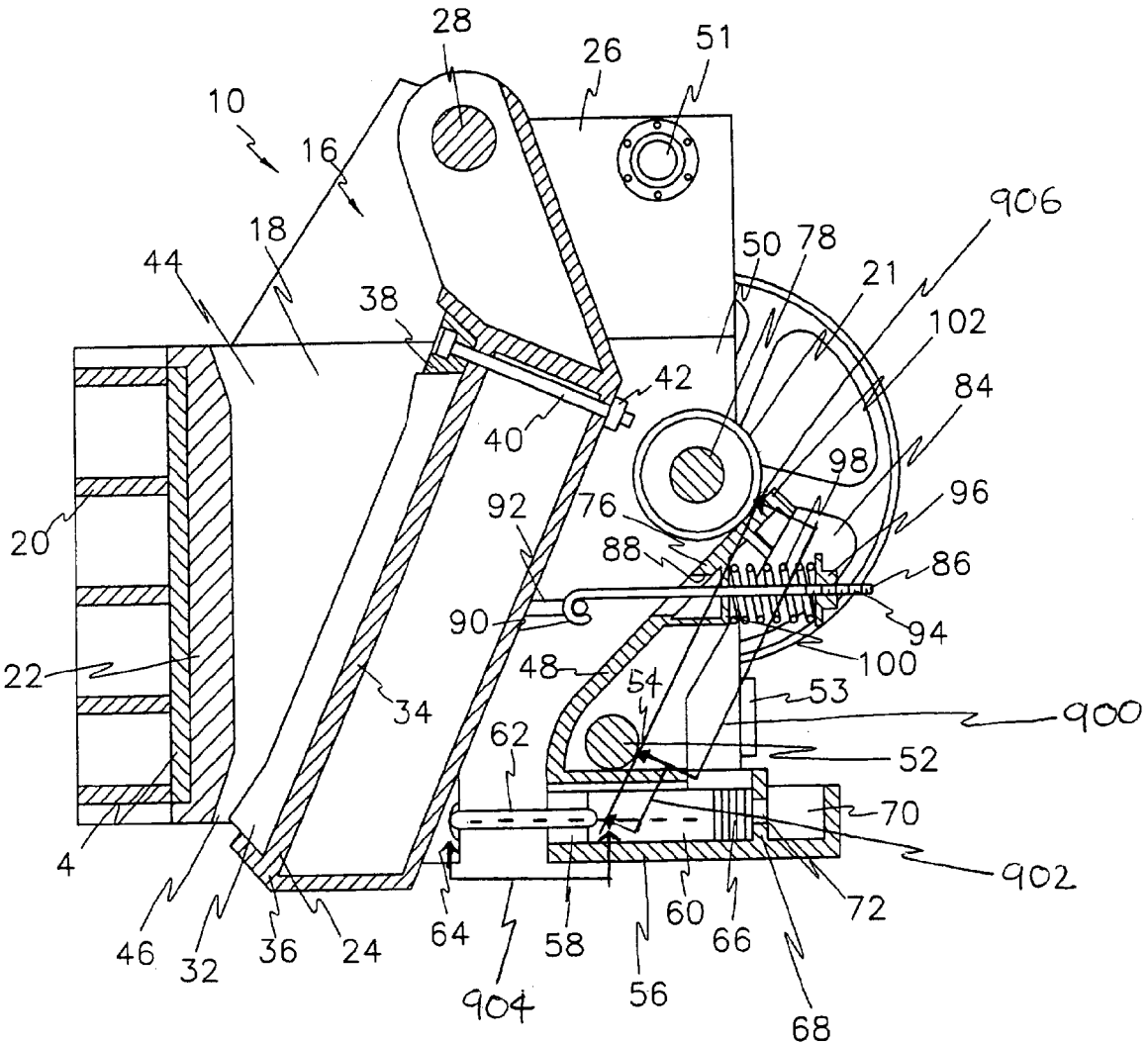
FIG. 1 is a cross sectional view of one embodiment of a jaw crusher of the present invention along line A–A' of FIG. 7.
Figure 15:
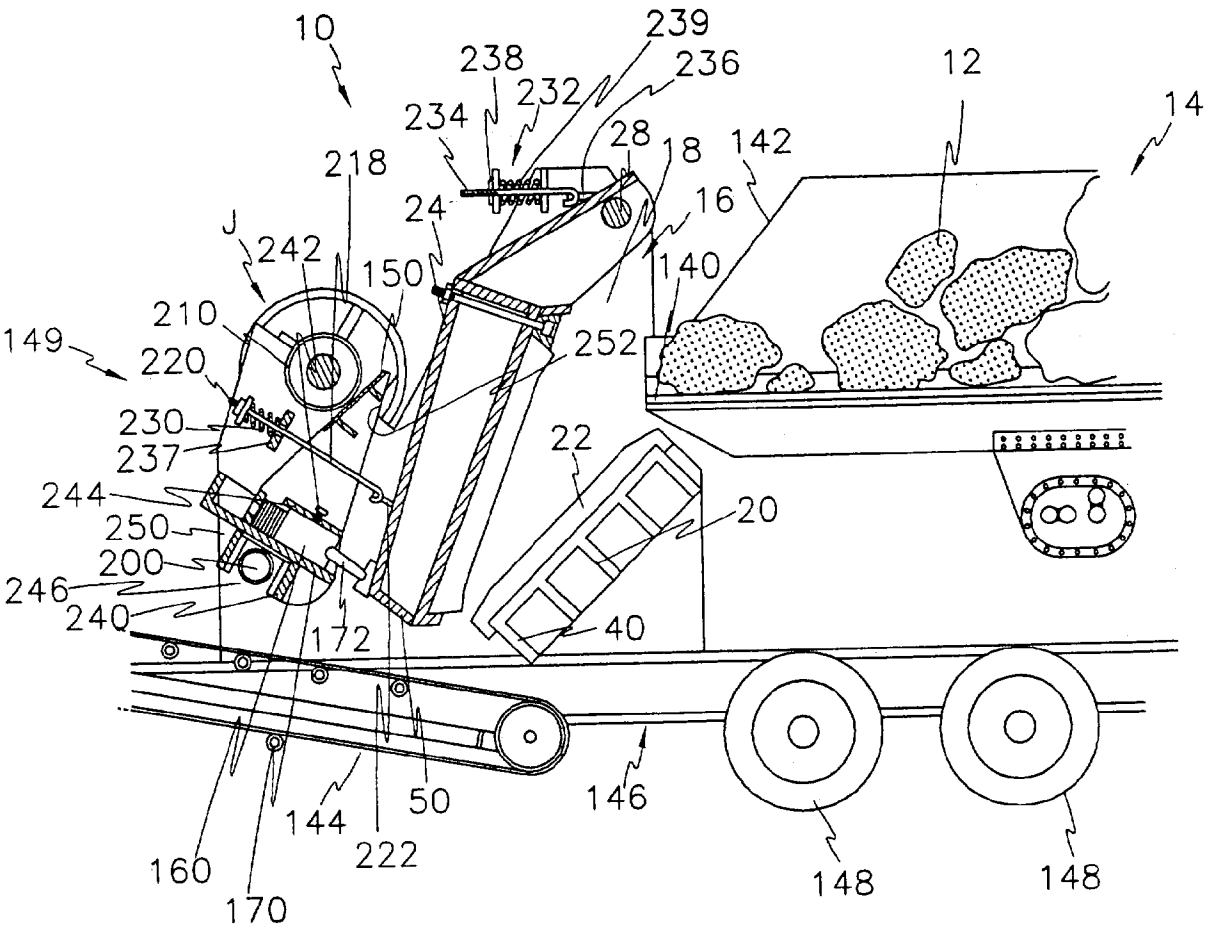
FIG. 15 is a simplified side view of a portable jaw crusher plant that includes a jaw crusher of a second embodiment of the invention.

Referring initially to FIGS. 1 and 15, jaw crusher 10 is used to crush stones 12 or other aggregate material as a primary crusher to reduce the size of stones 12 for further processing or for use in various applications. Jaw crusher 10 is employed as a part of crushing plant 14 components of which will be familiar to those skilled in the art. Stones 12 are conveyed into upper opening 16 of crusher 10 in order to enter crushing chamber 18 where rocks 12 are crushed.

Referring to FIGS. 1, 5, 6 and 7, crusher 10 includes stationary jaw assembly 20 to which stationary jaw liner plate 22 is rigidly attached. Stationary jaw assembly 20 is attached to side plates 50 of jaw crusher 10 and is fixed in place to form a fixed contact plate. Movable jaw assembly 24 is pivotably attached to movable jaw support plates 26 by means of movable jaw shaft 28 within bearing 30 (FIG. 3), to form a movable contact plate positioned and spaced opposed relationship with stationary jaw assembly 20. Bearing side covers 57 (FIG. 5) are positioned at each outer end of bearings 30 to protect and cover bearings 30. Stones 12 may be received between stationary jaw assembly 20 and movable jaw assembly 24 to be crushed between the plates, as movable jaw assembly rotates about movable jaw shaft 28 pivot axis constituting a first pivot axis.

Figure 6:
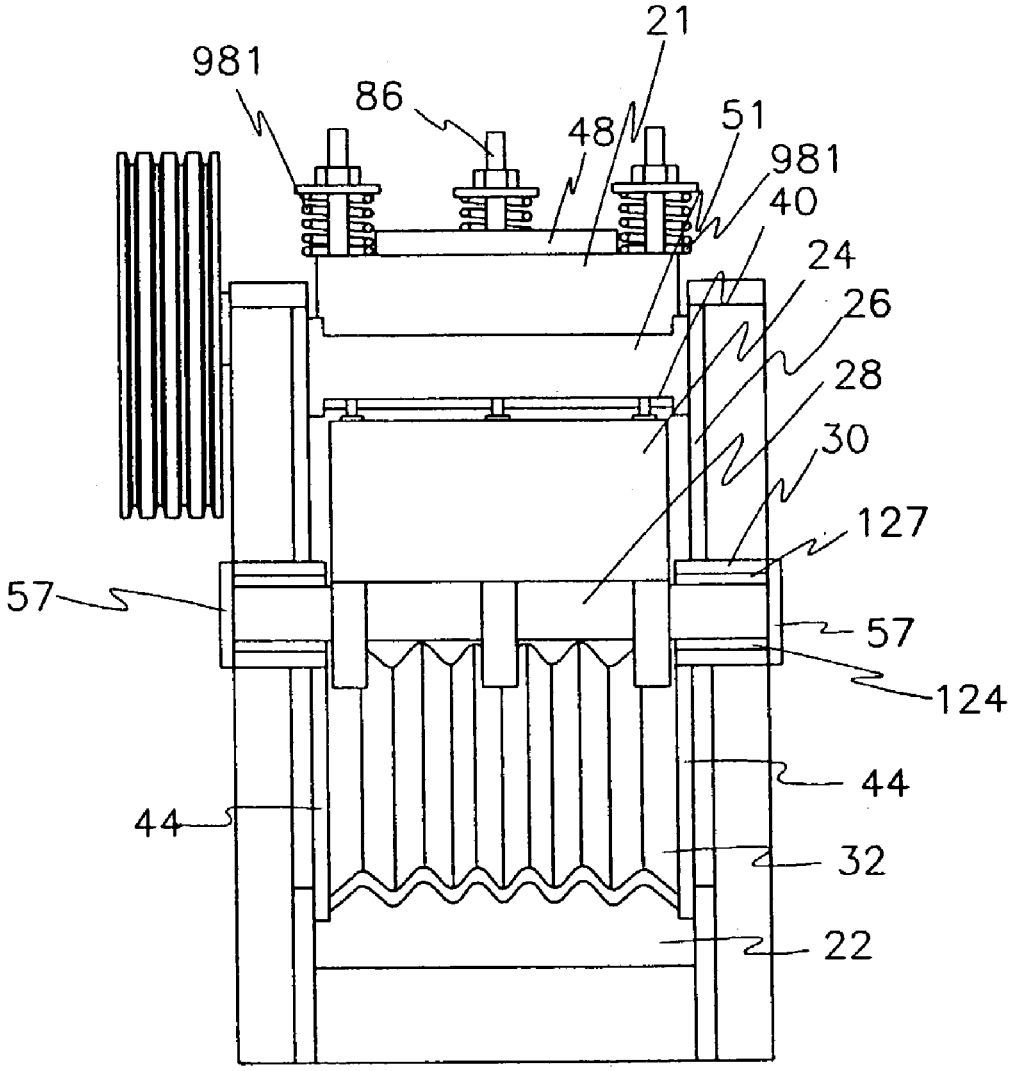
FIG. 6 is top plan view of the jaw crusher of FIG. 1.

Two side plates 50 extend in parallel spaced alignment on both sides of crusher 10. Plates 50 are rigidly attached to stationary jaw assembly 20 at one side and to side plate connecting pipe 51 and reinforcing plate 53 to define the frame of crusher 10. As seen in FIGS. 1 and 6, side plate connecting pipe 51 connects the pair of side plates 50 together.

Movable jaw liner plate 32 is attached to inner face 34 of movable jaw assembly 24 by being wedged against angled flange 36 by means of wedge 38 and wedge bolt 40 attached to movable jaw assembly 24 by means of nut 42. Movable jaw liner plate 32 may be removed by removable nut 42 and bolt 40 thereby releasing wedge 38 for the removal and replacement of movable jaw liner plate 32 when movable jaw liner plate 32 becomes worn. Similarly, stationary jaw liner plate 22 may be removed and replaced when it becomes worn.

A pair of spaced opposed cheek plates 44 (FIG. 6) are positioned adjacent each of the sides of crushing chamber 18 in parallel spaced alignment perpendicular to liner plates 22 and 32. Cheek plates 44 are inserted into grooves formed on each side of stationary jaw liner plate 22 at one end and on side plates 50 at their other end. Cheek plates 44 and liners 22 and 32 define crushing chamber 18 into which rocks 12 are adapted for crushing. Crushed rocks exit crushing chamber 18 through outlet 46 defined by a gap opening between the bottom of liner plate 22 and liner plate 32.

Figure 10:
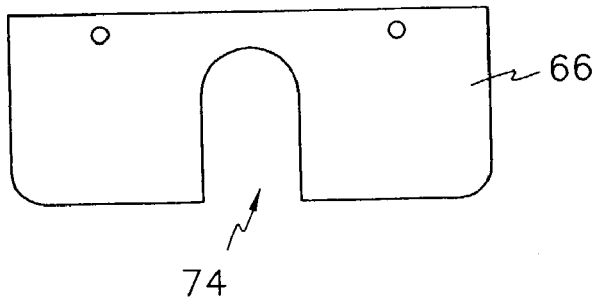
FIG. 10 is a top view of an adjusting steel plate used with the lever assembly of the jaw crusher of FIG. 1.
Figure 11:
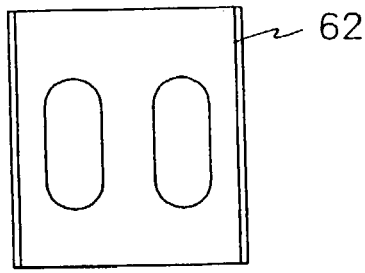
FIG. 11 is a top plan view of a toggle connecting the movable jaw with the lever of the jaw crusher of FIG. 1.
Figure 12:
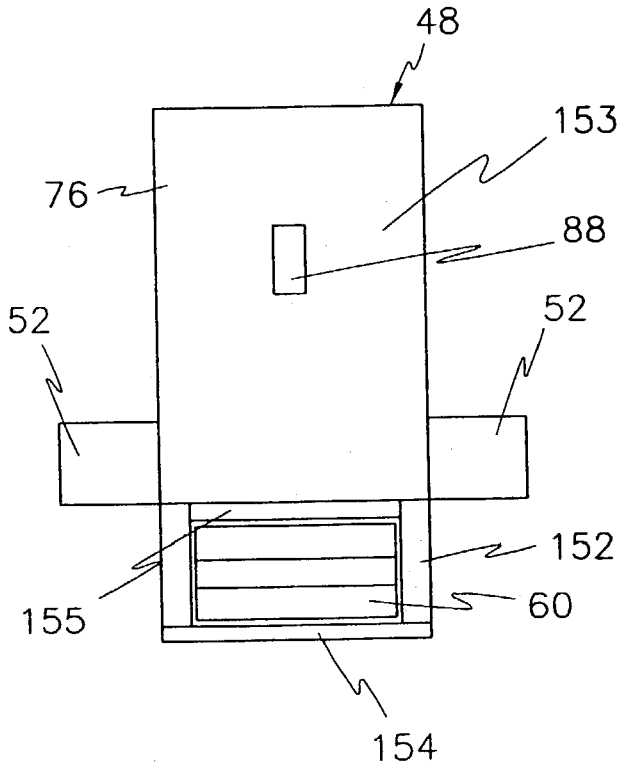
FIG. 12 is a front view of a lever assembly of the jaw crusher of FIG. 1.
Figure 13:
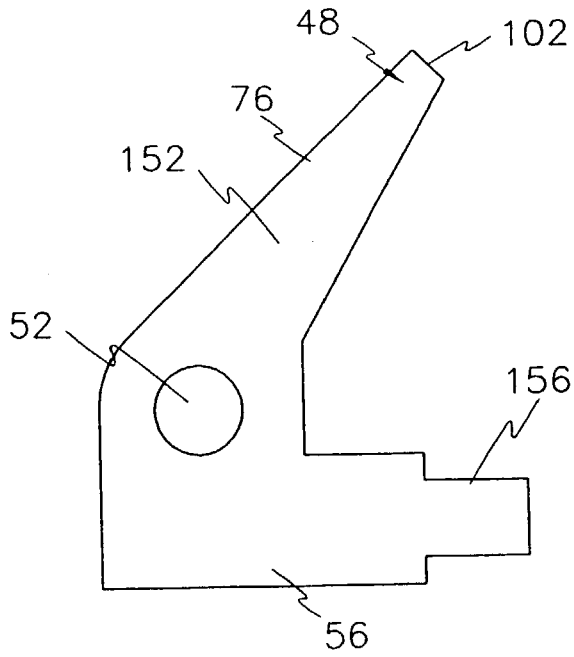
FIG. 13 is a side view of a lever assembly of the jaw crusher of FIG. 1.
Figure 14:
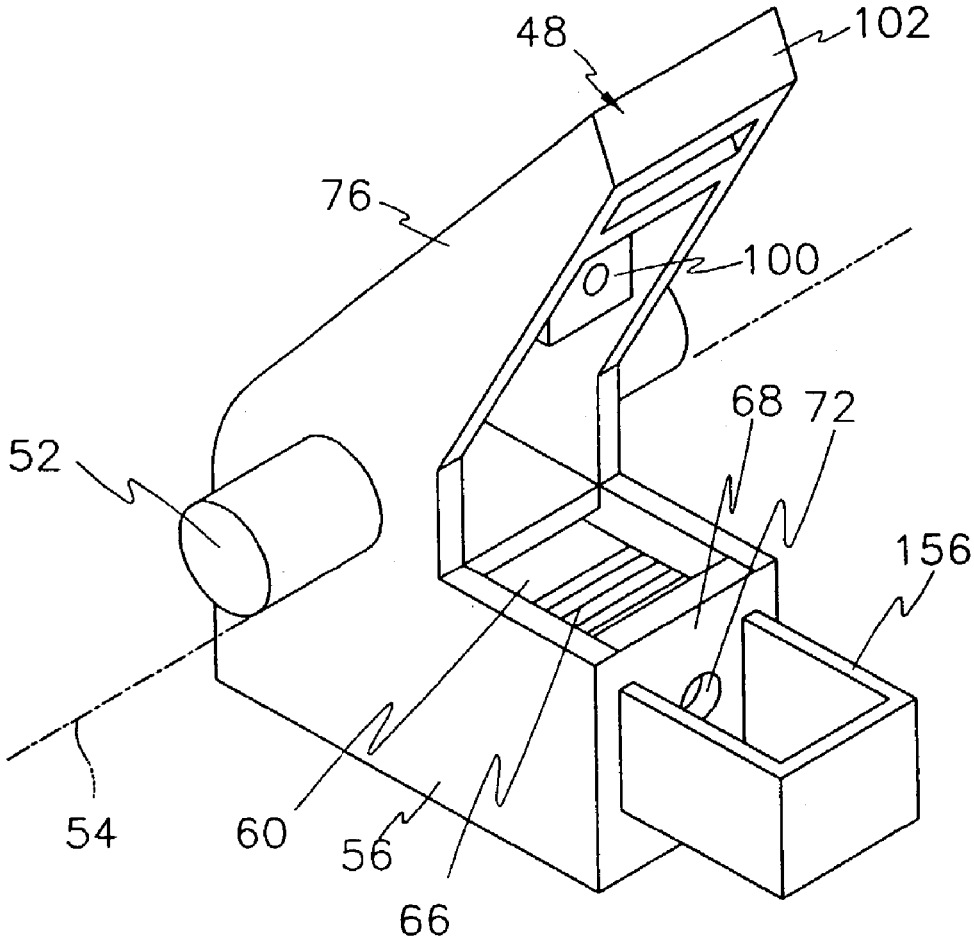
FIG. 14 is a perspective view of a lever assembly of the jaw crusher of FIG. 1.

Lever 48 is rotatably connected to side plates 50 positioned adjacent each side of movable jaw assembly 24, as best seen in FIG. 1. A pair of opposed co-axial shafts 52 (FIG. 12) are connected to lever 48 and are housed within bearing 55 in a similar manner as bearing 30. Shafts 52 are rotatable within bearing 55 (FIG. 2) to permit rotational movement of lever 48 about a pivot axis 54 comprising a second pivot axis (FIG. 14). Lever 48 includes housing 56 positioned below shafts 52 which extends rearwardly, in a direction away from movable jaw assembly 24. Housing 56 includes opening 58 into which removable adjusting block 60 maybe inserted. A toggle plate 62, seen in close-up in FIG. 11, is connected to the inner end of adjusting block 60, that is the end closest to movable jaw assembly 24. The other end of toggle plate 62 is connected to toggle seat 64 which is connected to a lower rear region of movable jaw assembly 24. A plurality of adjusting steel plates 66 (seen in close-up in FIG. 10) are positioned within opening 58 adjacent the outer end of adjusting block 60, that is the end furthest away from movable jaw assembly 24. It can be appreciated that the number of adjusting steel plates 66 may be varied to change the position of toggle plate 62 with respect to lever 48 thereby adjusting the distance between liner plates 22 and 32 to adjust outlet 46 opening. Adjusting steel plates 66, adjusting block 60 and toggle plate 62 are all supported by end wall 68 of opening 58.

Housing 56 further includes hydraulic jack access chamber formed at the rear end of housing 56 adjacent end wall 68. End wall 68 further includes opening 72 which permits a hydraulic jack to be inserted to apply pressure on adjusting block 60 through openings 74 in plate 66, as seen in FIG. 10. This allows pressure to be released from plate 66 to permit removal and addition of plate 66 to adjust outlet 46. Housing 56 and adjusting block 60 together form a first extension extending from pivot axis 54 and communicating with movable jaw assembly 24 to move movable jaw assembly 24 on movement of lever 48.

Lever 48 includes upper extension 76 extending upwardly from housing 56 and angled rearwardly, in a direction away from movable jaw assembly 24. Upper extension 76 forms a second extension extending from pivot axis 54 which is positioned with respect to housing 56 and adjusting block 60 to cause leveraged force to be applied to housing 56 and adjusting 60 on movement of upper extension 76 to cause lever 48 to move about pivot axis 54.

Figure 8:
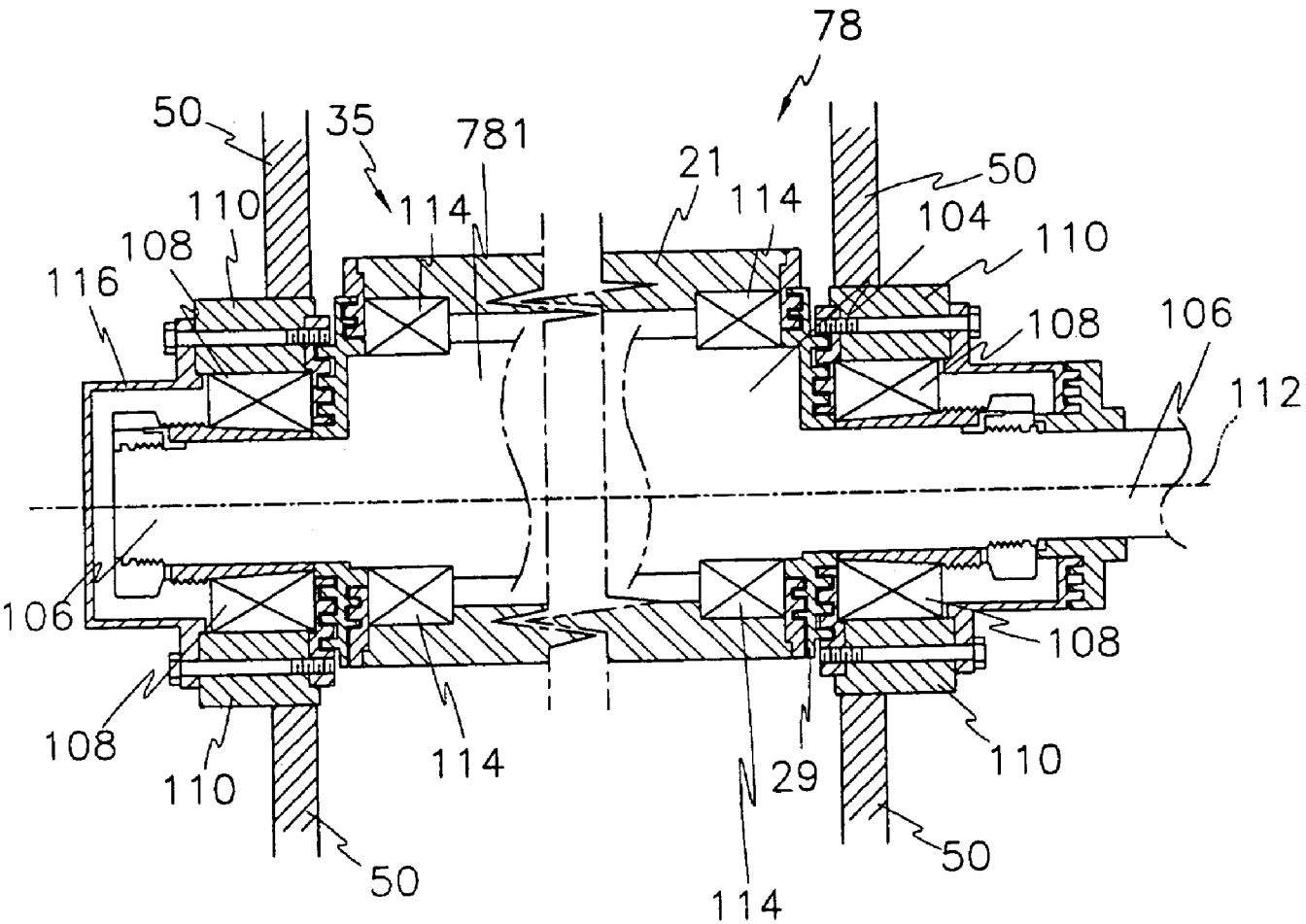
FIG. 8 is a close up cross sectional view of the eccentric shaft assembly of the jaw crusher of FIG. 1.
Figure 9:
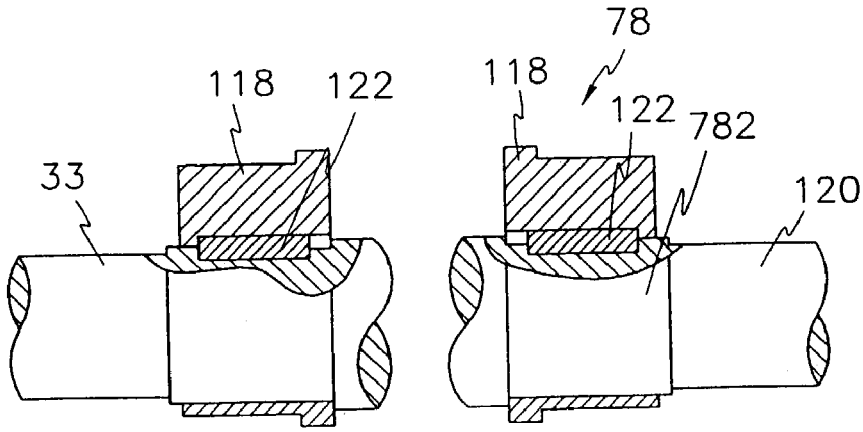
FIG. 9 is a close up cross sectional view of a sectional eccentric shaft assembly of the jaw crusher of FIG. 1.

Eccentric shaft 78 is connected to side plates 50 for rotation about the longitudinal axis of shaft 78. Two types of eccentric shafts 78 are depicted in FIGS. 8 and 9. FIG. 8 depicts a unitary eccentric shaft 80 and FIG. 9 depicts a sectional eccentric shaft 82.

Referring to FIG. 8, eccentric shaft 78, in the case of FIG. 8, unitary eccentric shaft 80 is supported by a pair of side plates 50. Shaft 80 includes axial extensions 106 at each end which are rotatably attached to plates 50 by means of main bearings 108 positioned in main bearing housing 110. Bearings 108 encircle extensions 106 and permit rotation of extension 106 and shaft 80 about shaft axis 112.

Pitman bearings 114 are positioned at both ends of eccentric part 104 of shaft 78. Eccentric part 104 contacts pitman bearings 114 which translate rotational movement of shaft 78 into reciprocating motion of roller body 21 which contacts upper extension 76 of lever 48 thereby imparting reciprocating motion on upper extension 76. A pulley and motor may be attached to an end of axial extension 106 to rotate shaft 78 about axis 112. Because applicant's invention employs lever 48 to drive toggle plate 62 eccentric part 104 may be manufactured to extend much further from axis 112 as compared to prior art eccentric shafts. For example, if lever 48 magnifies the force exerted by roller body 21 three times, eccentric part 104 can be dimensioned to permit movement of the eccentric part 104 against upper end 102 of extension 76 a distance which is three times greater than the distance moved by movable jaw assembly 24. Main bearing housing end cover 116 is used to cover one of the extensions 106 and prevent dust and dirt from entering the region around extension 106.

Because eccentric part 104 is relatively large it can be expensive and difficult to machine. As a consequence, I have developed a sectional shaft shown in FIG. 9 as an alternative to unitary shaft shown in FIG. 8. Two eccentric ring-shaped pitman bearing seats 118 are fastened onto shaft 120 by means of keys 122.

Note that bearings 108 and 114 are preferably rolling type bearings. However, the two pitman bearings 114 may be replaced with journal bearings in which case lubrication should be undertaken with an oil-based lubricant.

Lever 48 includes spring biasing system 84. Spring biasing system 84 includes inner tension rod 86 extending through hole 88 in upper extension 76. Inner end 90 of rod 86 is hook-shaped to engage latch 92 which is connected to movable jaw assembly 24. Outer end 94 of rod 86 is threaded and nut 96 may be positioned on outer end and tightened inwardly in the direction of movable jaw assembly 24. Spring 98 is interposed between nut 96 at its outer end and spring support 100 on extension 76 at the inner end of spring 98. Spring support 100 also has a hole. It can be appreciated that with nut 96 tightened downwardly to provide tension on spring 98 that spring 98 will bias or urge rod 86 outwardly which will cause movable jaw assembly 24 to likewise be urged outwardly so that movable jaw assembly 24 is positioned in its open position, that is in its position furthest away from stationary jaw assembly 20 with outlet 46 in its fully open position. The bias of spring 98 further causes movable jaw assembly 24 to push outwardly against toggle plate 62, adjusting block 60 and adjusting steel plate 66 against end wall 68. Further, the bias of spring 98 also causes lever 48 to pivot about pivot axis 54 so that upper end 102 of extension 76 contacts roller body 21. It should further be noted that when outlet 46 is in its fully open position, as depicted in FIG. 1, eccentric shaft 78 is positioned with respect to upper end 102 such that roller body 21 does not apply significant pressure on upper end 102 and consequently does not move upper end 102 outwardly away from movable jaw assembly 24 to cause lever 48 to pivot to reduce the size of outlet 46, as is described below. It is also possible to provide for more than one spring biasing system as necessary in order to ensure the return of movable jaw assembly 24 to the fully open position, that is position of movable jaw assembly 24 furthest away from stationary jaw assembly 20.

It can be readily appreciated that lever 48 acts as a force amplifying device in the same manner as a mechanical lever. Force applied on upper end 102 would be magnified and the resultant force on toggle plate 62 will be increased from the force applied at upper end 102.

Figure 2:
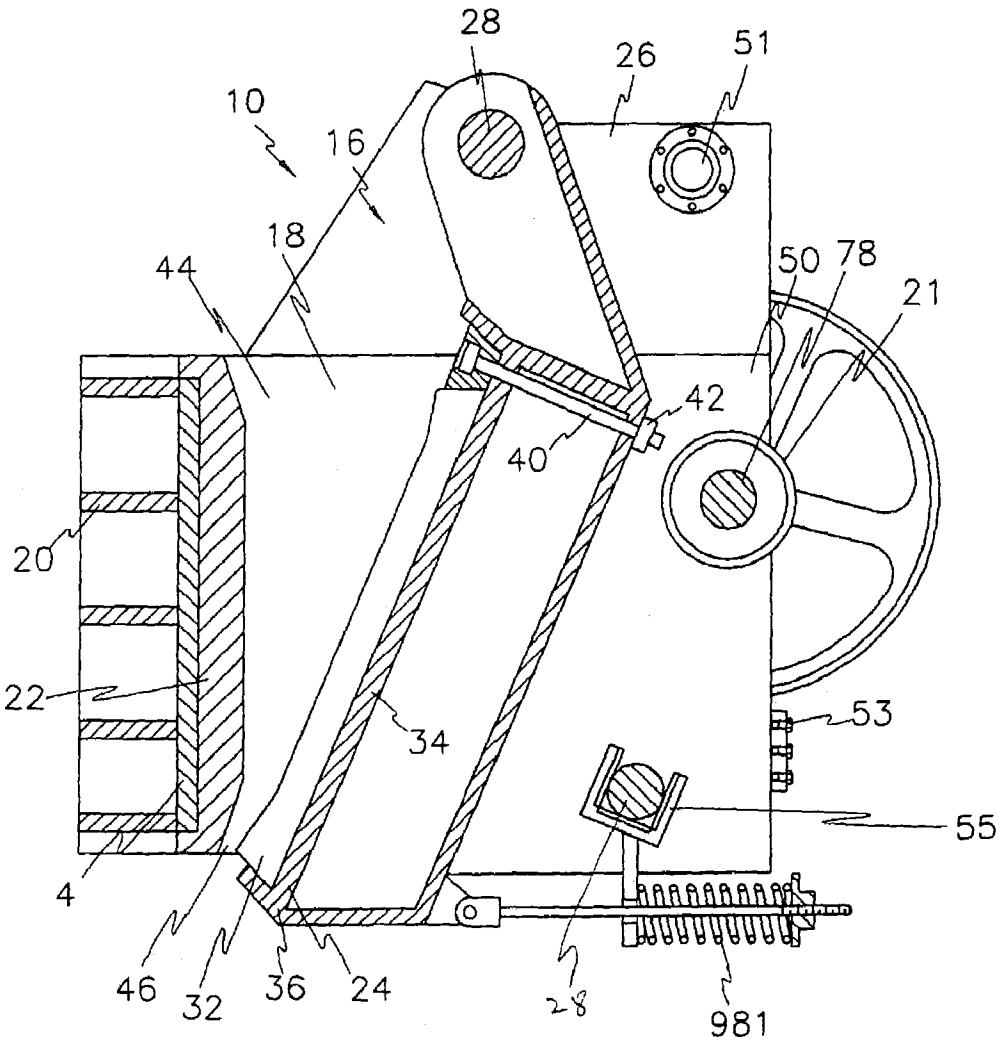
FIG. 2 is a cross sectional view of the jaw crusher of FIG. 1 along line B–B' of FIG. 7
Figure 3:
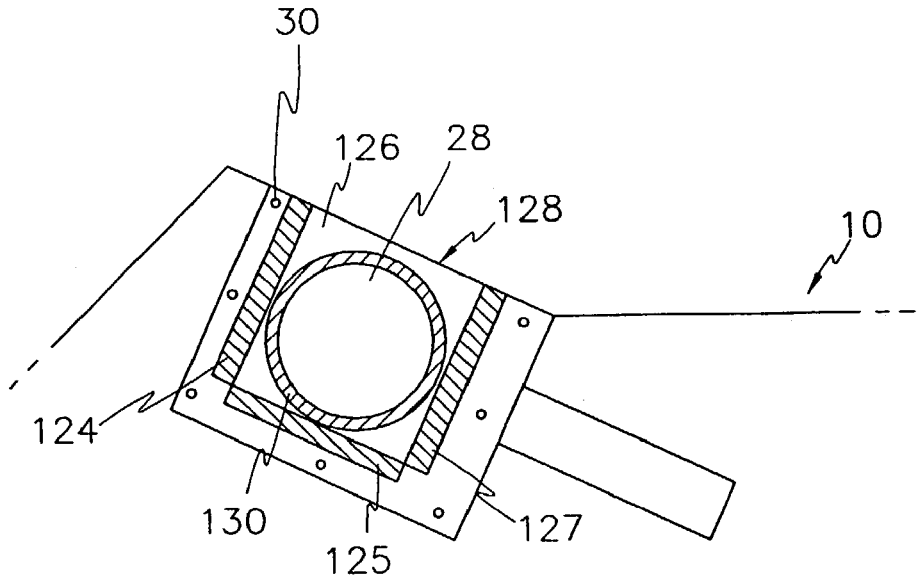
FIG. 3 is a magnified cross sectional view of the movable jaw shaft and its bearing of the jaw crusher of FIG. 1, showing the state of the shaft when the movable jaw is in its farthest position from the stationary jaw.
Figure 4:
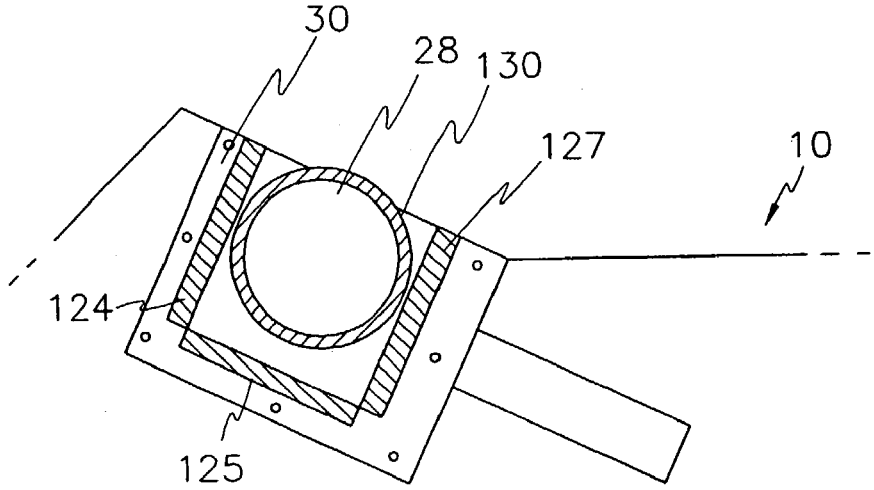
FIG. 4 is a magnified cross sectional view of the movable jaw shaft and its bearing of the jaw crusher of FIG. 1, showing the state of the shaft when the movable jaw is in it's closest position to the stationary jaw.
Figure 5:
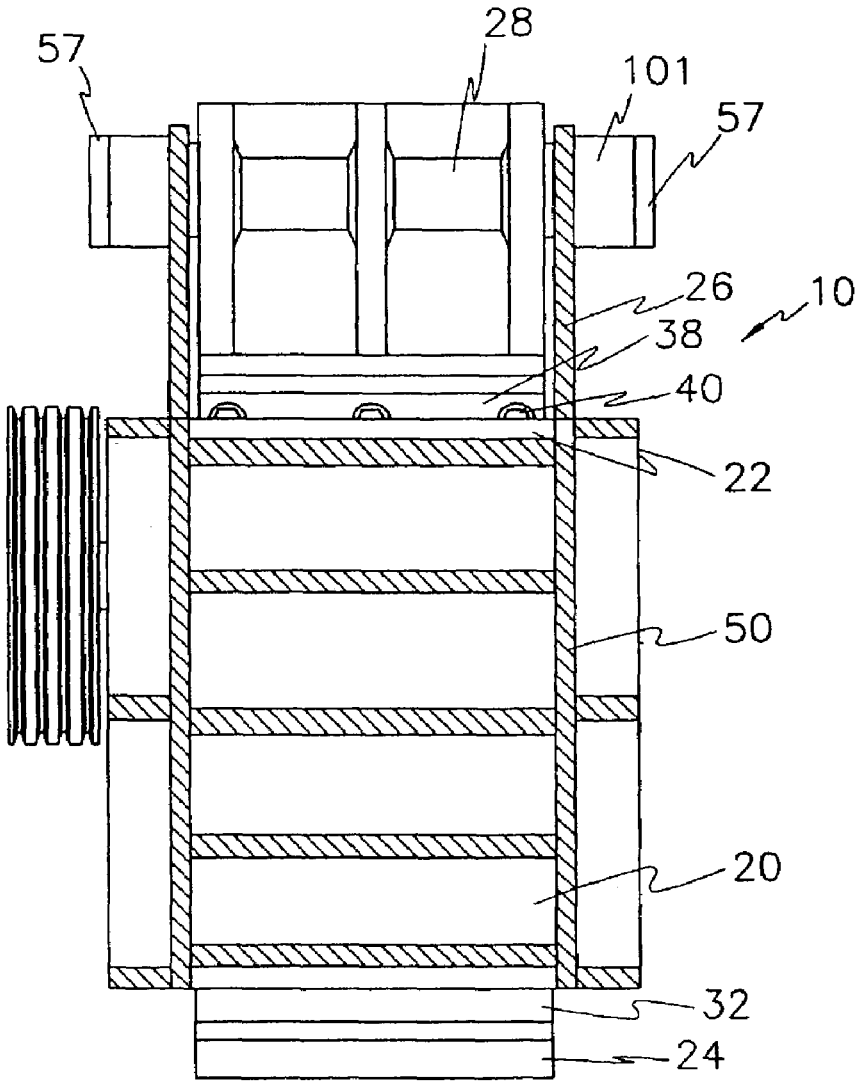
FIG. 5 is a front view of the jaw crusher of FIG. 1.

Referring to FIGS. 3 and 4, shaft 28 is housed and supported in bearing 30, with shaft 28 rotating within bearing 30. Bearing 30 includes three housing walls, left wall 124, lower wall 125 and right wall 127 forming cavity 126 in which shaft 28 is contained. Cavity 126 is open at open end 128 forming a gap region of bearing 30. Walls 124, 125 and 127 are constructed of heat-treated material. Shaft 28 is covered with a layer of heat-treated lining 130 which protects the shaft from wear due to friction between lining 130 and walls 124, 125 and 127, as shaft 128 rotates about pivot axis 54. The distance between the bearing walls 124 and 127 is slightly greater (for example 1 millimeter) than the diameter of the movable jaw shaft liner 130. Movable jaw shaft 28 is forced against bearing wall 127 by biasing spring 98 and by crushing force of stones 12. Movable jaw shaft liner 130 does not contact the left wall 124 under normal operating conditions. Bearing 30 is offset from a vertical position to provide an orientation of wall 127 perpendicular to the direction of crushing force of stones 12 in crushing chamber 18 (see similar orientation of bearing 55 of FIG. 2). This orientation helps prevent shaft 28 from slipping when it rotates and receives strong crushing force of stones 12. The ideal offset angle of right wall 127 is that of a plane defined by movable jaw liner plate 32. But deviation within 15 degree is acceptable.

FIG. 3 depicts the position of shaft 28 within bearing 30 when movable jaw assembly 24 is furthest away from stationary jaw assembly 20. FIG. 4 depicts shaft 28 oriented with respect to bearing 30 when movable jaw assembly 24 is closest to stationary jaw assembly 20. The crushing of stones 12 occurs during the movement, or stroke, of movable jaw assembly 24 from its furthest position with shaft 28 positioned as depicted in FIG. 3 to its closest position with shaft 28 positioned as depicted in FIG. 4. During this stroke movable jaw shaft 28 receives very strong force and movable jaw shaft 28 in turn presses against right wall 127 strongly and rolls up along the surface of right wall 127. During this movement no frictional wear occurs because there is no slip between shaft 28 and wall 127. Frictional wear is proportional to the multiplication of the applied force to the surface of contact and the distance of slip. In effect movable jaw shaft 28 rolling along right wall 127 between the positions depicted in FIG. 3 and FIG. 4 constitutes a kind of huge rolling bearing.

Movable jaw shaft 28 rolls down along the surface of right wall 127 during the discharge stroke, that is movement of movable jaw assembly 24 away from stationary jaw assembly 20. During discharge stroke movable jaw assembly 24 moves from closest position of FIG. 4 to furthest position of FIG. 3 and crushed stones move downward along the crushing chamber 18 and some of them are discharged from the crushing chamber through outlet 46 (FIG. 2).

Figure 30:
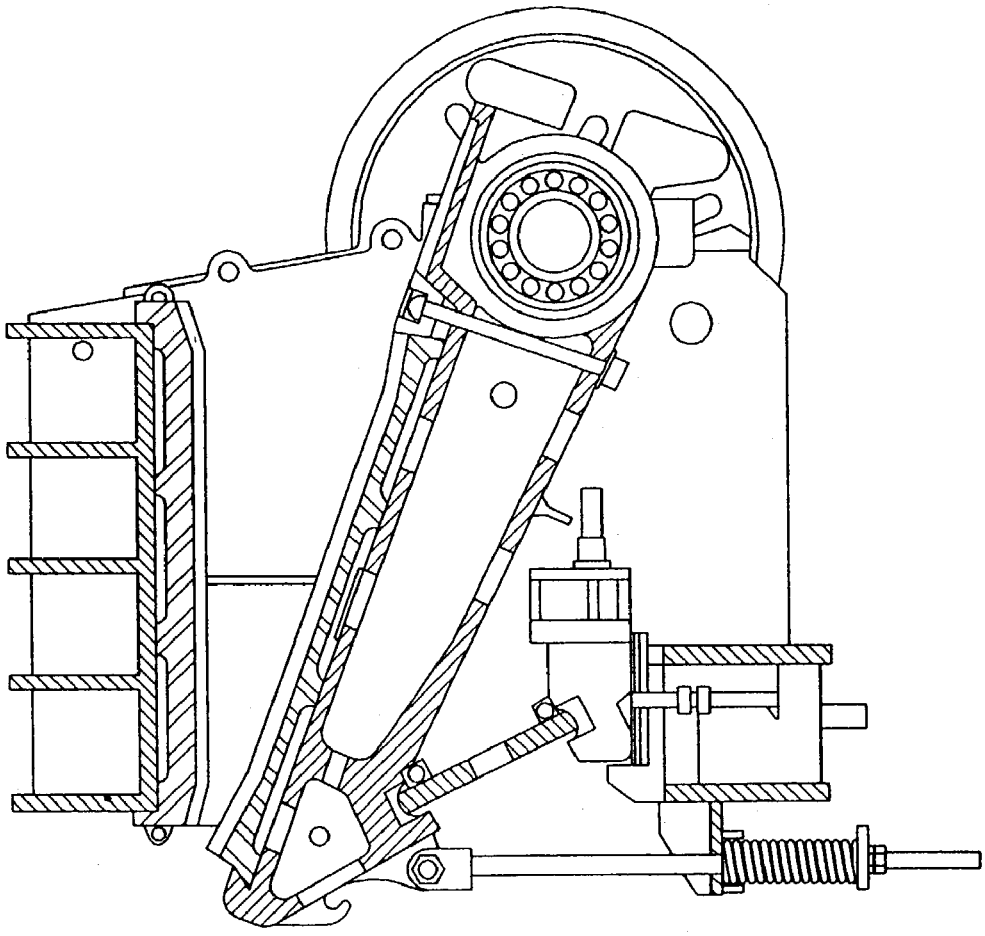
FIG.30(Prior Art)
FIG. 30 is a cross sectional view of a prior art single toggle jaw crusher.

The movement of movable jaw shaft 28 within bearing 30 is only 2 or 3 millimeters even in large jaw crushers and the angle of rotation of movable jaw shaft 28 is less than one degree. This is a very difficult condition to solve in prior art bearings, namely pin and bushing assembly. In a pin and bushing assembly, a small angle of rotation and strong force make lubrication a very difficult task because in order to maintain a proper lubrication film under strong force between the surface of pin and bushing with some speed of rotation (for example 1 meter/sec) a continuous supply of lubricant is essential. In prior art crushing machines attempts to solve the problem of providing a continuous supply of lubricant were undertaken using a circulation pump. But this did not solve this problem at a low speed of rotation. If the speed of rotation of the shaft is low, lubrication film is destroyed and frictional wear between the pin and the bushing occurs. Lubricant supplying devices are also complicated and costly and cause many maintenance problems as well. Normal rolling bearings are expensive and quite big in size. Rolling bearings used in prior art single toggle jaw crushers as depicted in FIG. 30, are most expensive components of those crushers.

The special rolling bearing of present invention reduces significantly maintenance cost and associated problems, particularly problems of lubricating movable parts in a dusty environment. This also reduces manufacturing cost. But it should be noted that although the use of the rolling bearing of the present invention is preferred, the jaw crusher of the present invention with the lever can adopt a pin and bushing assembly as well, if it is appropriate.

Figure 7:
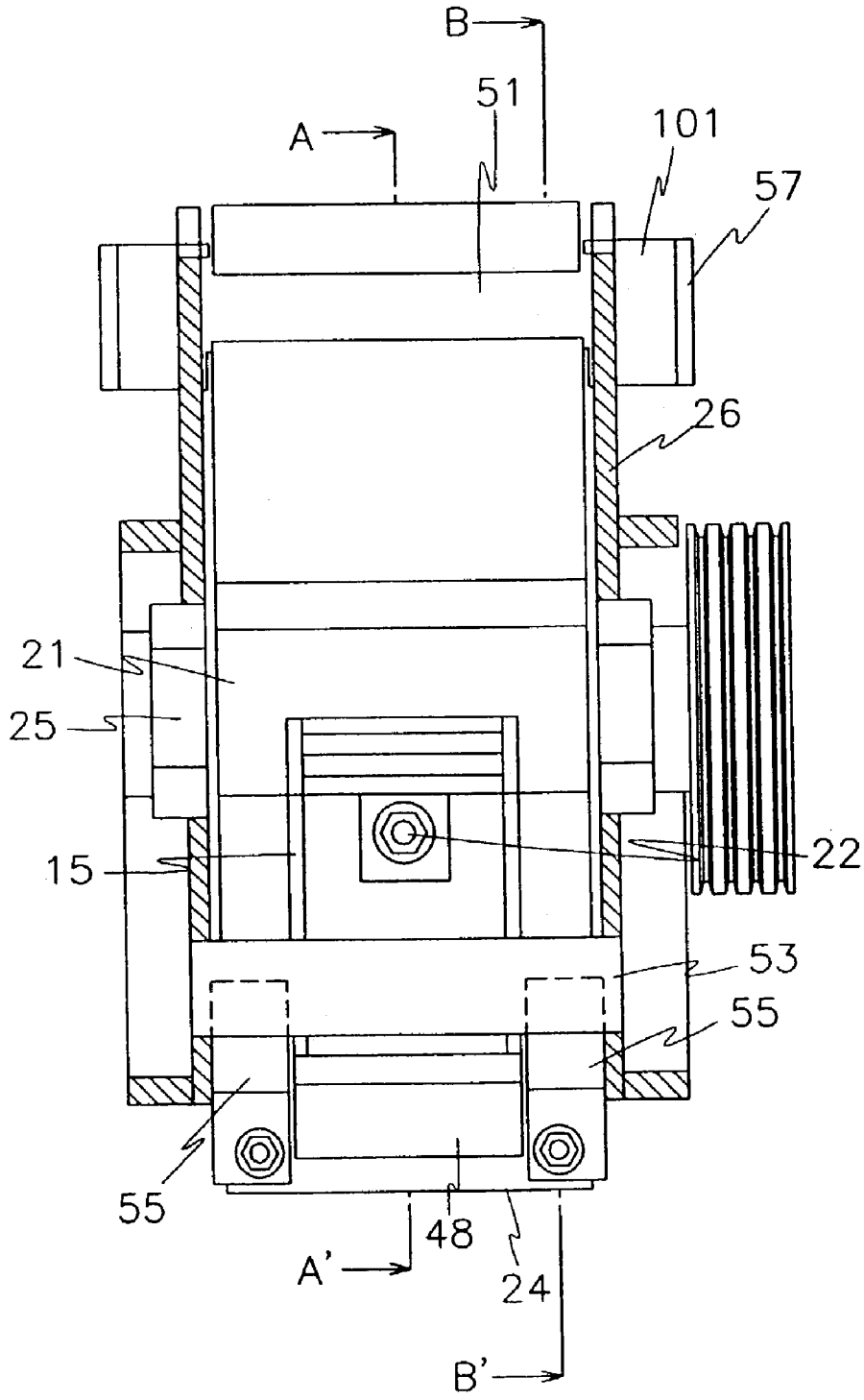
FIG. 7 is a rear view of the jaw crusher of FIG. 1.

FIG. 2, depicts the jaw crusher of FIG. 1 but along line B'—B' of FIG. 7. Bearing 55 supports shaft 52 and operates in a similar manner as shaft 28 within bearing 30 as discussed above with respect to FIGS. 3 and 4. Bearing 55 is angled similarly to that of bearing 30 to position its right wall (equivalent to wall 127) perpendicular to the direction of the crushing force applied by movable jaw assembly 24. Shaft 52 rises within a cavity similar to cavity 126, which movement occurs at the same time as shaft 28 rises within bearing 30. However, as regard shaft 52 in bearing 55, shaft 52 rises further into the cavity of bearing 55 as it rotates against the bearing wall of bearing 55 furthest away from stationary jaw assembly 20, as compared to the distance that shaft 28 rises into cavity 126 as shaft 28 rotates against bearing wall 127. This is due to the greater rotational distance traveled as lever 48 rotates about axis 54.

A second embodiment of the invention will now be discussed with reference to FIG. 15. FIG. 15 depicts a portable jaw crusher plant 149. It is composed of jaw crusher 10, feeder 140, hopper 142, a conveyor belt 144 and a chassis 146 with wheels 148 and brakes (not shown).

A portable jaw crusher plant 149 is designed to travel on roads and its height is restricted by governmental laws and regulations. The highest part of a jaw crusher plant 149 is normally hopper 142. In order to lower the height of hopper 142 to ensure compliance with height regulations for road transportation, the height of feeder 140 which forms the bottom of hopper 142 must be lowered. Feeder 140 is located above and adjacent stationary jaw assembly 20, and stationary jaw assembly 20 may be slanted in order to lower its height to enable feeder 140 and hopper 142 to be lowered to reduce the overall height of plant 149.

In this embodiment of the invention, the structure of the lever assembly is different from that of FIG. 1, sometimes referred to as a "type A" lever. The type of lever depicted in FIG. 15 is sometimes referred to as a "type B" lever. In both type of levers, namely in a type A lever and in a type B lever, the first extension of the lever is defined as the part extending from the lever shaft axis to the center line of a toggle plate or to the center of a force transferor (discussed below) which contacts the movable jaw assembly 24. The second extension of the lever is defined as the part extending from the lever shaft axis to the part of lever contacting the eccentric roller or other reciprocating drive such as an hydraulic cylinder. Note that in a type B lever the second extension includes the first extension.

In the type A lever depicted in FIG. 1, the first extension can be conceptualized by imaginary line 902 extending from lever axis 54 to the center axis of toggle plate 62. The second extension can be conceptualized by imaginary line 900 extending from lever axis 54 to contact point 906 of upper extension 76 with roller 78. Force transferor 904 comprises toggle plate 62 connecting movable jaw 24 and lever 48.

Figure 19:
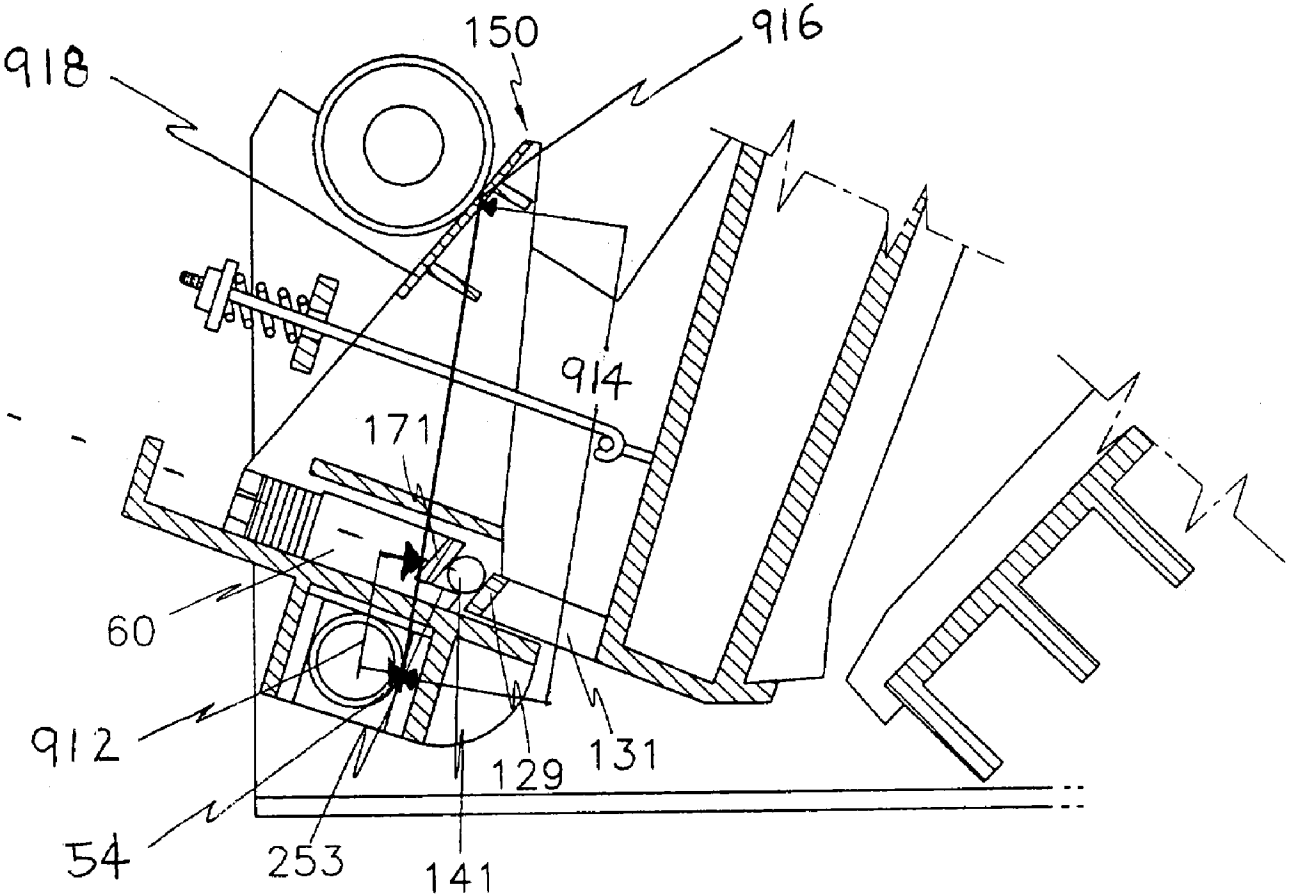
FIG. 19 is a cross sectional view of a fourth embodiment of the present invention showing another embodiment of a force transmission roller assembly.

In the type B lever depicted in FIG. 19, the first extension can be conceptualized by imaginary line 912 extending from lever axis 54 to the longitudinal axis of adjusting block 60. The second extension can be conceptualized as an imaginary line 914 extending from lever axis 54 to contact point 916 of upper extension 918 of lever 150. Force transferor comprises movable jaw force transfer plate 131. Note that in the type B lever first extension is incorporated as a part of the length of the second extension and the force transferor is located at one end of the first extension and at an intermediate point along the second extension.

Lever shaft 200 which supports lever 150 is located below opening 160 rather than above opening 58 in the embodiment of FIG. 1. Lever shaft 200 is fixed to side plates 250 not to the lever 150. As well, the lever shaft bearing 240 is positioned under the opening 160 supported by shaft 200 for pivotal movement of bearing 240 and lever 150 about shaft 200. The construction and the function of opening 160 are the same as that of the embodiment shown in FIG. 1.

The upper end or second extension 252 of lever 150 is in contact with eccentric roller 210 which operates to impart reciprocating motion on second extension 252 in the same manner as previously described with respect to the first embodiment depicted in FIG. 1. The surface of lever shaft 200 and the lever shaft bearings 240 are covered with hard heat treated linings as previously described. Bearing 240 includes open end 246 which permits bearing 240 and lever 150 to move upwardly in a direction which moves shaft 200 in the direction of open end 242 when movable jaw assembly 24 is moved toward stationary jaw assembly 20 by lever 150.

The direction of the movement of the upper end 252 of lever 150 of FIG. 15 is the same as that of the movable jaw assembly 24. Tension rod 218 is connected to hook 222 on the rear side of movable jaw assembly 24 and extends through an opening in lever 150 (similar to opening 88 on lever 48.) In order to provide tension to lever 150 and movable jaw assembly 24, and to eliminate any spaces between the various contacting elements, one end of tension rod 218 is connected by means of a spring 230 and nut 220 to bracket 232 that is fixed to the side plates 250.

The other end of tension rod 218 is connected to movable jaw assembly 24 as in FIG. 1, and tension spring 230 causes movable jaw assembly 24 to be pulled backward toward lever 150. As hook 222 is located on a lower part of movable jaw assembly 24, the tension force on movable jaw shaft 28 is insufficient to keep movable jaw shaft 28 in contact with the bearing walls (nor shown).

So in this embodiment, one more tensioning means 232 is located on the upper part of the movable jaw assembly 24. Tensioning means 232 includes tensioning rod 234 connected to hook 236 attached to an upper rear portion of movable jaw assembly 24. Nut 238 compresses spring 239 which causes force to be applied on rod 234 to pull movable jaw assembly 24 in the direction of lever 150 forcing shaft 28 against a bearing side wall (not shown).

A nut hole and bolt combination 242 is positioned on the top 244 of opening 160 to prevent movement of adjusting block 170 when the adjusting block 170 and the toggle plate 172 are assembled.

In the second embodiment of FIG. 15, the jaw crusher 10 is partly slanted in order to reduce its height. But it should also be understood that crusher 10 can be oriented in a more upright manner as depicted in FIG. 1 with respect to the first embodiment.

Figure 16:
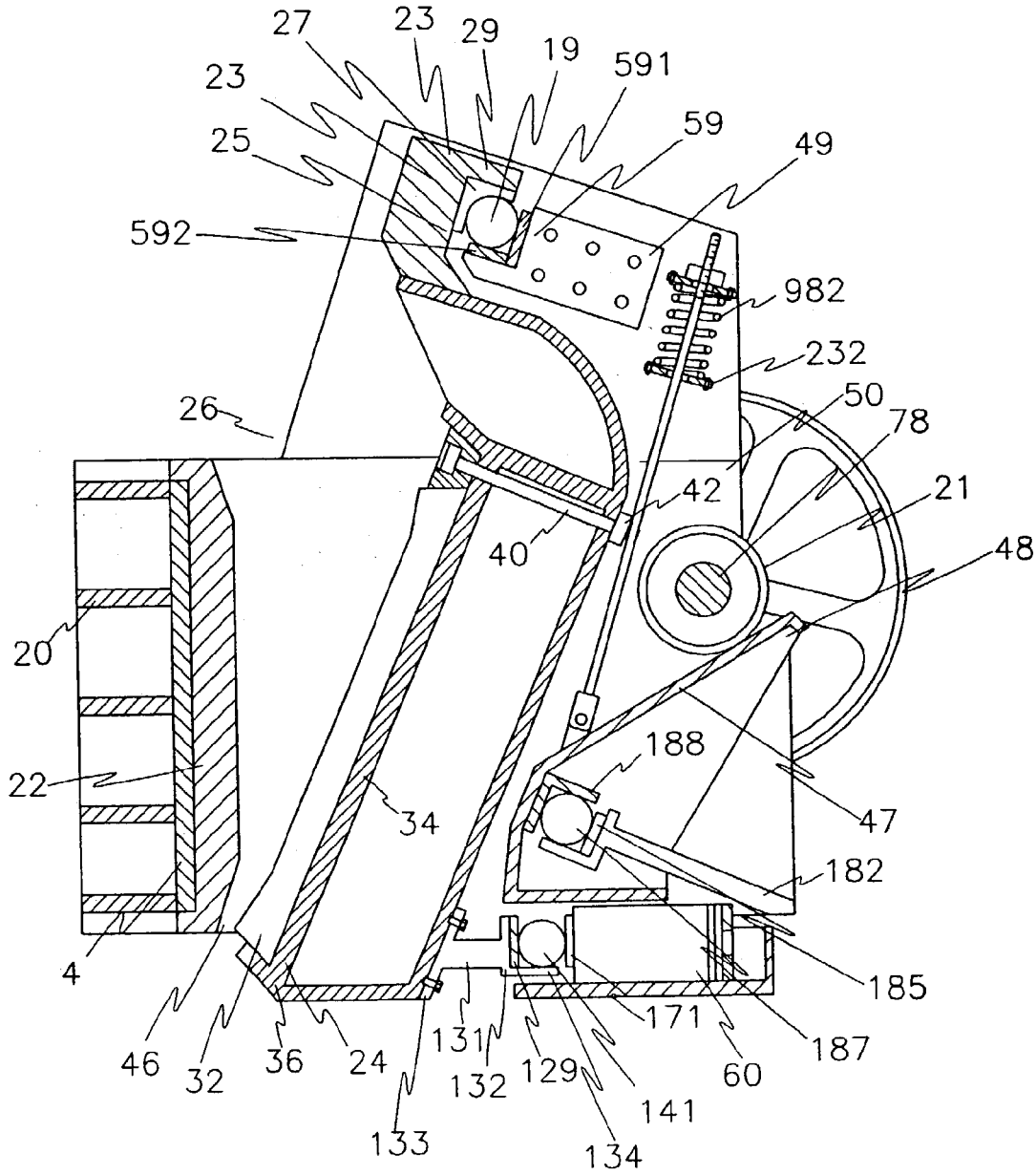
FIG. 16 is a cross sectional view of a third embodiment of a jaw crusher of the present invention showing an alternate mechanism for transmitting force from the lever assembly to the movable jaw and alternate mechanisms for supporting the movable jaw and the lever.

FIG. 16 depicts a third embodiment of the invention. This embodiment provides a force transferor from lever 48 (a type A lever) to the movable jaw assembly 24 which differs from toggle plate 62 of FIG. 1 and toggle plate 172 of FIG. 15. This embodiment also provides a different way of supporting the movable jaw and the lever.

Roller seat 171 is fixed on an end of adjusting block 60 and roller seat 129 is fixed on head 132 of movable jaw force transfer plate 131. Foot 133 of movable jaw force transfer plate 131 is fixed to the back plate of the movable jaw assembly 24. Force transfer roller 141 is supported by flange 134 and is sandwiched between seats 171 and 129. When lever 48 pushes movable jaw assembly 24 toward stationary jaw assembly 20, force transfer roller 141 rolls upward along the face of the roller seat 129 and it rolls down along the face of the roller seat 171. This rolling motion is reversed when movable jaw assembly 24 moves away from stationary jaw assembly 20 when assembly 24 moves to its rest position as depicted in FIG. 16. This rotational movement reduces power loss and wear significantly.

Now referring FIG. 16, FIG. 17 and FIG. 18 an alternate way of supporting the movable jaw assembly 24 and lever 48 will be explained.

The principle and mechanism of supporting lever 48 and movable jaw assembly 24 is all the same. So in referring to FIG. 17 only the manner of supporting lever 48 will be explained.

Lever support plate 180 has a head 181 and a body 182. The body 182 is rigidly attached to side plates 50 to receive the crushing force of rocks. The head 181 is narrower than the body 182 and it enters into lever 48 between the side plates 50 of lever 48. The head 181 has two cover plates 183 that are attached to the head 181 rigidly by embedded bolts 184.

The head 181 also has a heat treated roller seat 185 covering the vertical inner face of the head 181.

Base plate 186 of the head 181 is vertical to the roller seat 185 and it supports a portion of the weight of the lever 48 when the lever 48 is not in operation.

The head receives cylindrical lever roller 187 within the space made by the base plate 186 and two side cover plates 183 and the roller seat 185, and support the lever roller 187 securely.

The lever roller 187 is in contact with lever angle 188 which is fixed to the inner surface of back plate 47 of lever 48. The inner surface of the lever angle 188 fits well to the surface of the lever roller 187 and it has some grip on the lever roller 187. So there is no slip between the lever angle 188 and the lever roller 187 and it moves together when the lever 48 is in operation.

In the stroke in which lever 48 pushes the movable jaw assembly 24 towards the stationary jaw assembly 20, the lever roller 187 rolls up along the surface of the roller seat 185 just like the movement of the movable jaw shaft in FIG. 3 and FIG. 4 and the lever roller 187 rolls down in the return stroke. No significant wear or energy loss will arise.

As explained above the same principle and mechanism are applied to the movable jaw support system. Movable jaw hanger 23 has a slanted vertical inner face 25 and ceiling flange 29 and a replaceable moveable jaw angle 27 is assembled to the inner surface of the moveable jaw hanger 23. Under the moveable jaw angle 27 is placed a long moveable jaw roller 19 and the moveable jaw roller 19 is supported by an angle shaped head 59 of movable jaw support plate 55. Moveable jaw support plate 55 is fixed rigidly to upper frame 26 to support the crushing force of rocks.

The head 59 of the moveable jaw support plate 55 has a slanted vertical and a slanted horizontal faces and they are covered by hard heat treated linings 591 and 592. The operation of this moveable jaw single roller bearing is same as that of lever single roller bearing.

One thing to be noted is that when the moveable jaw is not crushing rocks (for example when running empty or in the return stroke) there may be slip between the roller 19 and linings 591 and 592. In this case the load on the single roller bearing is only the weight of the moveable jaw 24 and the angle of rotation of the roller 19 is very small, the wear of the roller 19 and linings 591 and 592 is negligible.

In large jaw crushers, the weight of lever 48 reaches 10 tons and it is difficult to prevent the slip of lever roller 187 by the biasing force of spring 981 (FIG. 2). In such cases, there is a need to relieve the weight of the lever 48 from lever roller 187 in order to prevent the slip of lever roller 187 along the surface of the lining 185.

In FIG. 16 depicts a new biasing system to eliminate or reduce the weight of the lever 48 from lever roller 187. In this state lever roller 187 rolls up and down along the surface of lining 185 without slipping due to the pressing force of spring 981 (FIG. 2).

Figure 17:
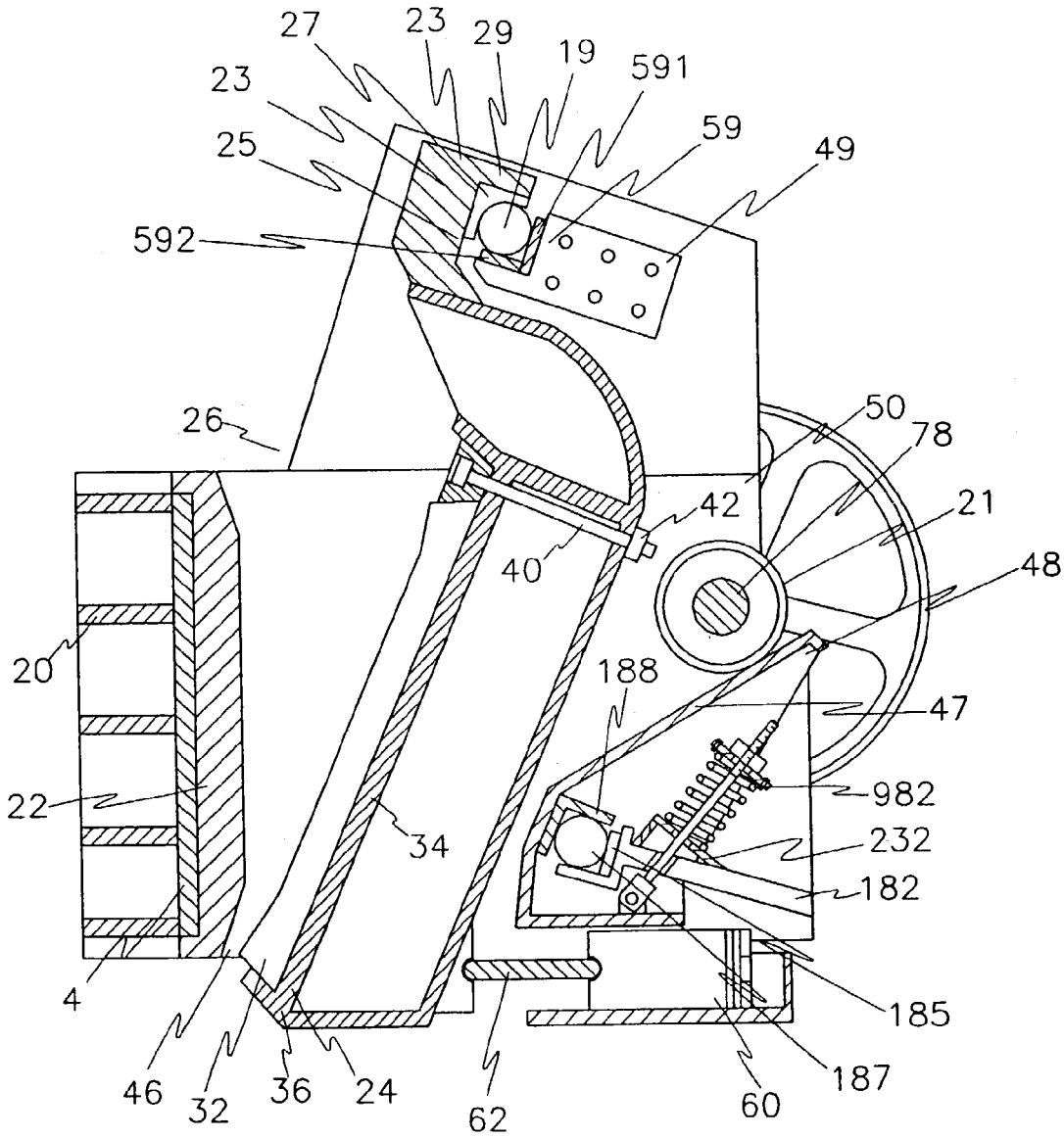
FIG. 17 is a cross sectional view of an embodiment of a jaw crusher which shows an alternate means of biasing the lever to relieve the weight of the lever from the lever roller.
Figure 18:
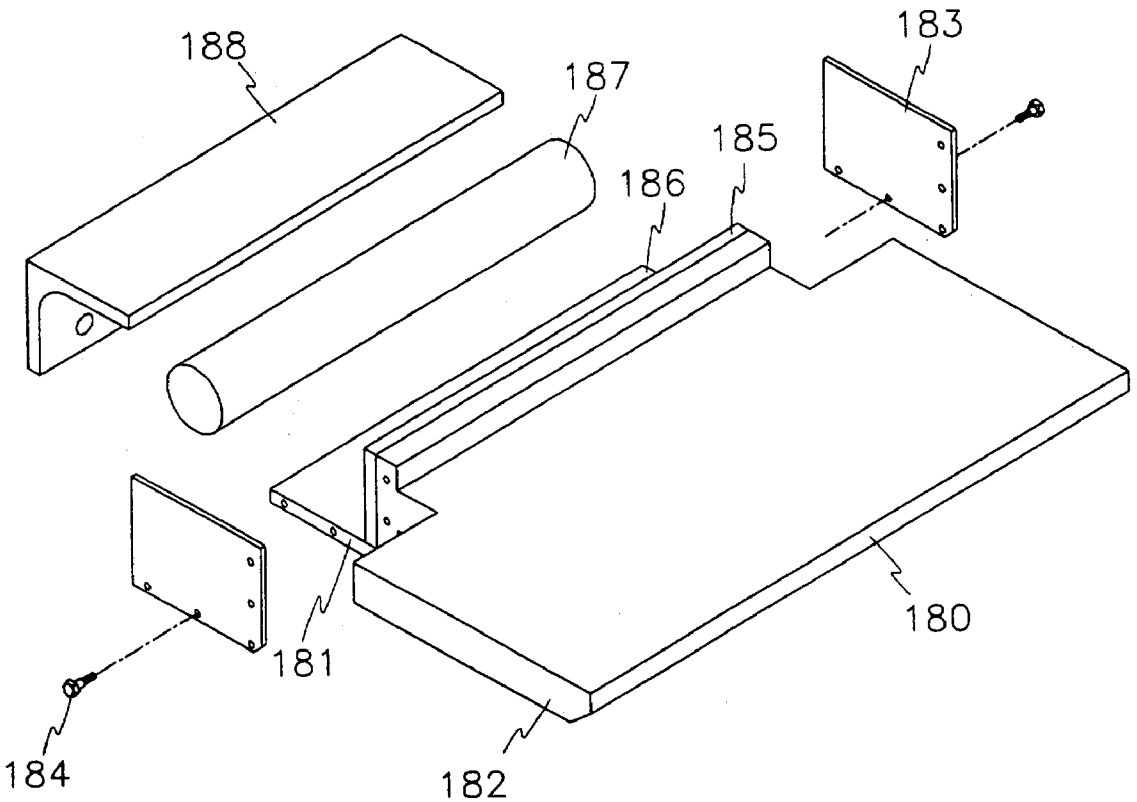
FIG. 18 is a perspective exploded view of the lever supporting bearing of the jaw crusher of FIG. 16.

FIG. 17 depicts another embodiment of the lever biasing system to relieve the weight of the lever from lever roller 187. In this embodiment the hinge plate is fixed to the rear part of the top of the adjusting housing 56 and the spring seat is fixed to lever support plate 182 and the lever receives upward and rearward force from the biasing spring. The upward vector portion of the force is used to relieve the weight of the lever from the lever roller 187 and the rearward vector portion of the force is used to press lever roller 187 to lining 185. So both vector portions of the biasing force are effectively used to prevent slipping of the lever roller 187 along the surface of the lining 185 even when the jaw crusher is running empty.

FIG. 19 shows a type B lever 150 with a force transfer roller 141. The force transfer mechanism using force transfer roller 141 and related components as described with respect to FIG. 16 may also be used with type B lever 150. But in this case the movement of lever 150 is the reverse of type A lever 48 and the movement of force transfer roller 141 is in the opposite direction to that described with respect to FIG. 16. The roller support flange 253 is formed on adjusting block 60.

Figure 20:
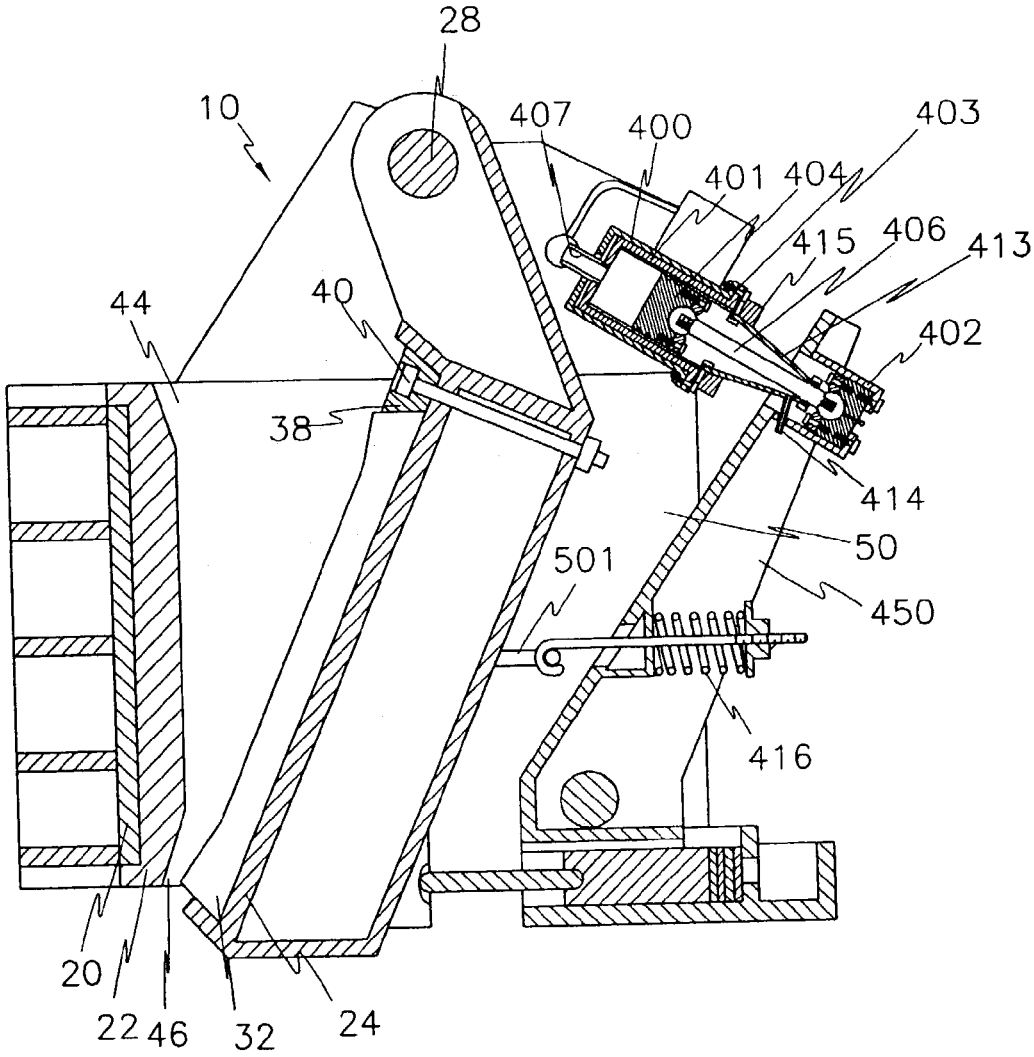
FIG. 20 is a cross sectional view of a fifth embodiment of a jaw crusher of the present invention showing a hydraulic lever driving mechanism.
Figure 21:
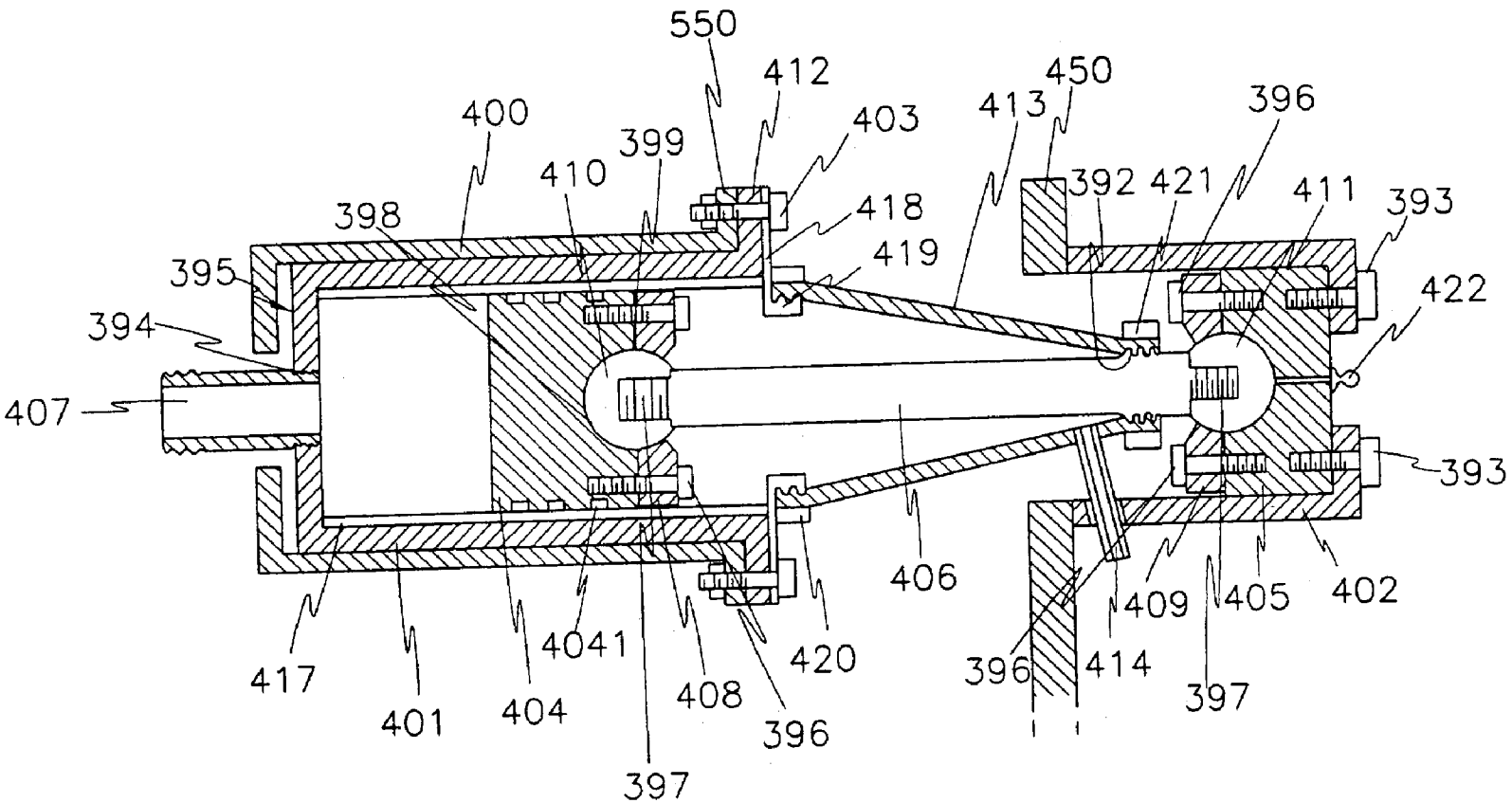
FIG. 21 is a magnified cross sectional view of a hydraulic cylinder assembly of the embodiment of FIG. 20.

FIG. 20 and FIG. 21 depict the fourth embodiment of the invention. In this embodiment, lever 450 is driven by hydraulic cylinders 401 instead of an eccentric roller.

Figure 22:
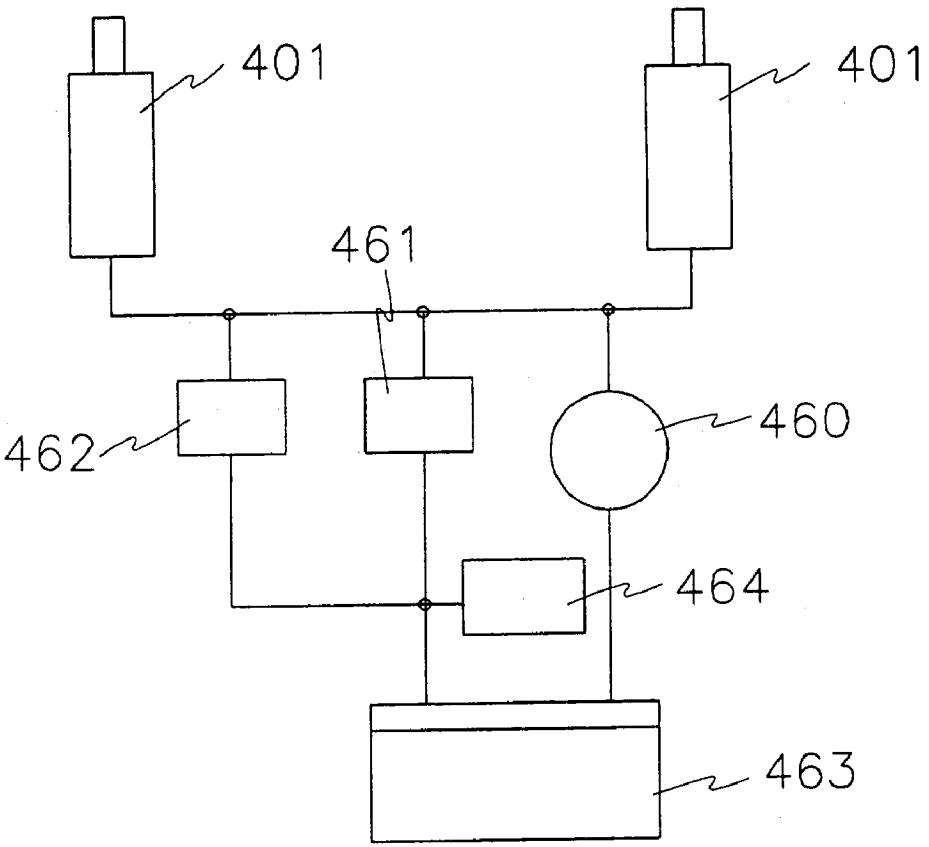
FIG. 22 is a simplified schematic of hydraulic circuit to drive the lever of the embodiment of FIG. 20.
Figure 28:
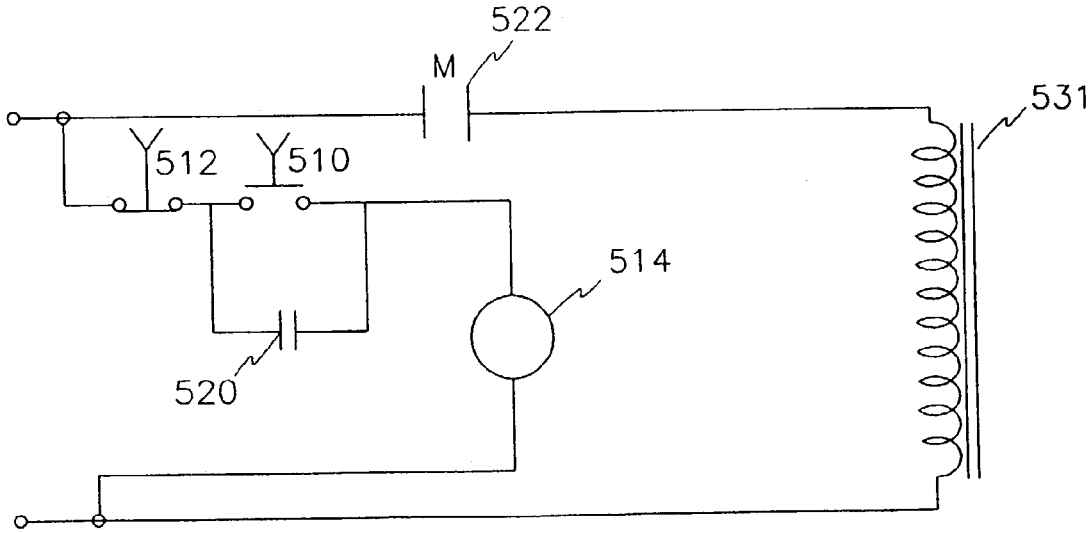
FIG. 28 is a simplified view of an electrical circuit for the control of the hydraulic valve of FIG. 24.
Figure 29:
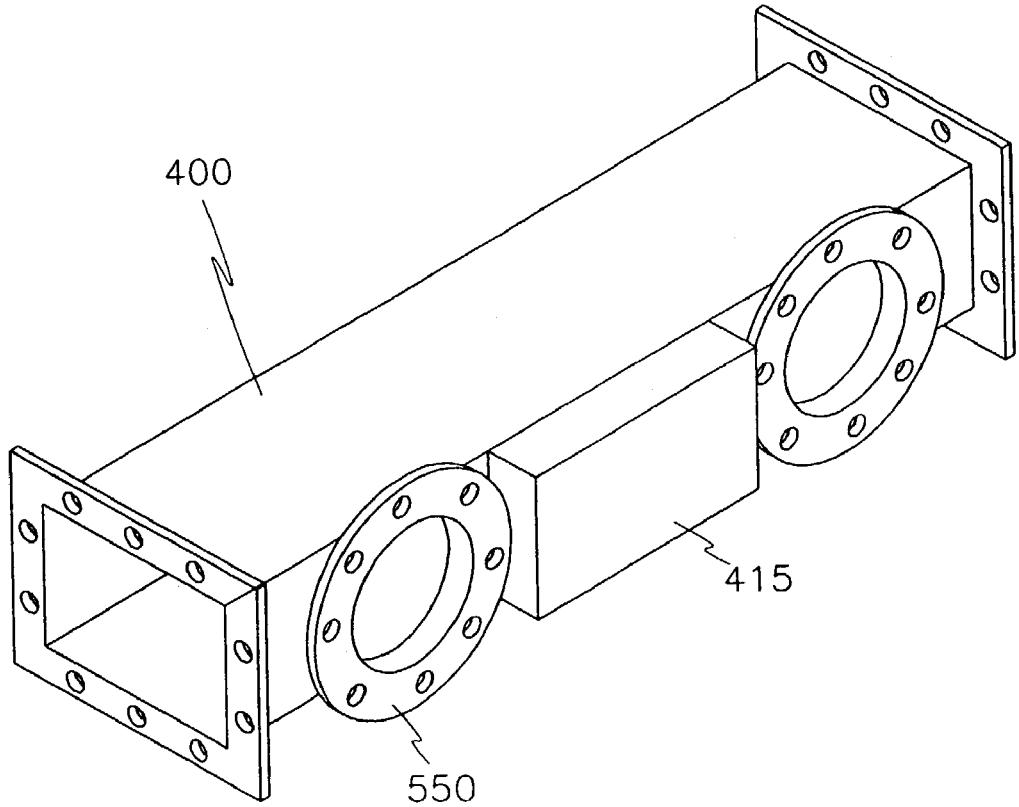
FIG. 29 is a perspective view of the square pipe of the embodiment of FIG. 20.

FIG. 22 depicts a cross sectional view of the hydraulic cylinder 401 and related parts seen in FIG. 19 as a part of crusher 10. Side plate connecting pipe 51 of FIG. 1 is substituted by rectangular cross sectioned pipe 400 with one or more circular openings on one side of pipe 400 (FIG. 28). Said circular openings include flange 550 of pipe 400 at their peripheries. Hydraulic cylinder 401 is positioned and fixed by bolts 403 extending through flange 412 of cylinder 401 and flange 550 of pipe 400.

Hydraulic cylinder 401 includes a piston 404 positioned within cylinder 401 for reciprocal movement axially within cylinder 401. Outer surface 399 of the piston 404, includes a half sphere groove 398 and a first end 410 of piston rod 406 is fitted in groove 398. On the upper part of the lever 450 facing the hydraulic cylinder 401, are positioned holes corresponding to the number of hydraulic cylinders 401 employed. The piston rod seat 405 includes a half sphere groove and a fixed washer 409 to admit the second end 411 of the piston rod 406 in the same manner as piston 404. First end 410, and second end 411 of piston rod 406 are of spherical shape and include a threaded inner core hole 397. Ends 410 and 411 are attached to piston rod 406 by threads formed at the end of piston rod 406. The spherical ends 410 and 411 of the piston rod 406 are kept in position by a washers 408 and 409 respectively which are fixed by bolts 396 to piston 404 and piston rod seat 405. A hole 394 with thread is formed on the end cap 395 of hydraulic cylinder 401. Pipe 407 is threaded into hole 394 in end cap 395 of hydraulic cylinder 401, to admit hydraulic oil.

On the upper part of the lever 450 facing the hydraulic cylinder 401, are positioned holes corresponding to the number of hydraulic cylinders 401 employed. Each hole includes a fixed pipe 402 of similar diameter as that of hydraulic cylinder 401.

Hydraulic cylinder 401 is protected from dust by cone shaped rubber membranes 413. One end of the rubber membrane is connected to the rubber membrane flange 418 which is attached to flange 412 by bolt 403. The rubber membrane flange 418 includes a short tube 419 extending perpendicularly with grooves on its outside periphery.

Rubber membrane 413 is fixed on the tube 419 by compressing it with ring 420, which is forced over tube 419 and membrane 413 to retain membrane 413 between ring 420 and tube 419. The other end of rubber membrane 413 is fixed by sandwiching membrane 413 between ring 421 and grooves 392 which are formed on piston rod 406 near the spherical end 411. The rubber membrane 413 has a drain pipe 414 to let out small amounts of leaking hydraulic oil to an hydraulic oil tank (not shown). Stop 415 is made of rubber and restricts lever 450 when it moves toward the movable jaw assembly 24 to the certain limit and defines the starting point of the movement of the lever 450.

The interior of the hydraulic cylinder 401 is covered by a hard heat treated liner 417 inside of cylinder 401. Piston 404 includes piston rings 4041 which provide an effective seal of hydraulic oil with piston liner 417. The half sphere shape grooves on pistons are lubricated by leaking hydraulic oil and the grooves on the piston rod seats are lubricated by grease that is supplied through grease nipple 422.

FIG. 22 shows an hydraulic circuit to drive cylinder 401.

Hydraulic pump 460 supplies a constant amount of high pressure hydraulic oil to cylinder 401. Timing valve 461 closes and opens periodically, for example 100 to 300 times per minute, to cycle between a position where hydraulic pressure is applied to cylinder 401 and a position where no hydraulic pressure is applied to cylinder 401.

Relief valve 462 opens when excessively high pressure develops in the high pressure line of the circuit. This situation occurs, for example, when unbreakable objects such as ironware products are in crushing chamber 18 of crusher 10.

When no hydraulic pressure is delivered to cylinders 401, timing valve 461 is in its open state. In that state lever 450 pushes on hydraulic cylinders 401 until lever 450 is in contact with the stop 415 by the force of springs 416 and by the force of springs of other biasing system (see FIG. 20 and FIG. 2).

Hydraulic pump 460 supplies hydraulic oil to the circuit. When timing valve 461 is open, the hydraulic oil returns to the hydraulic oil tank 463, and there is no movement of the hydraulic cylinders 401. Hydraulic pump 460 is driven by an electric motor (not shown) or by an engine (not shown) and its operating speed is normally over 1500 rpm. Because the hydraulic pump operates at this high rate of speed it is advantageous to connect the shaft of the hydraulic pump to the shaft of the prime mover directly.

Because the crushing action of a jaw crusher 10 is intermittent, there is a need to store the energy of a power unit or prime mover during the non crushing cycle of the crusher 10 by mechanical means.

In this invention, a flywheel is mounted on the shaft of the prime mover. The rotational speed of a prime mover is several times higher for example 69 times than that of the eccentric shaft of a jaw crusher. So a smaller flywheel can store the same amount of kinetic energy as a big flywheel of a jaw crusher of the prior art. This helps reduce the weight and the cost of the jaw crushers 10 of the invention.

When the hydraulic pump 460 reaches its normal speed, the timing valve is set to open and close periodically by starting the driving motor of the timing valve. When the timing valve 461 is closed, the hydraulic oil enters the hydraulic cylinders 401 and the hydraulic cylinders push the lever 450 and the movable jaw assembly 24 crushes stones 12. When timing valve 461 opens the hydraulic oil from the hydraulic pump 460 together with oil from the hydraulic cylinders 401 which are forced to retract by spring 416 returns to the hydraulic oil tank 463 through timing valve 461. At the same time lever 450 moves toward hydraulic cylinders 401 until it is stopped by stop 415 on the square pipe 400. During this cycle, the accumulator 464 accepts some amount of hydraulic oil and releases it when the timing valve 461 is closed. This action of the accumulator 464 reduces the hydraulic hammering effective due to the relatively long return conduit to hydraulic oil tank 463.

When the timing valve 461 closes, the crushing action of the crusher 10 repeats. If uncrushable material such as the tooth of hydraulic backhoe enters into the crushing chamber the relief valve 462 opens thereby protecting the hydraulic circuit from excessively high pressure.

Figure 23:
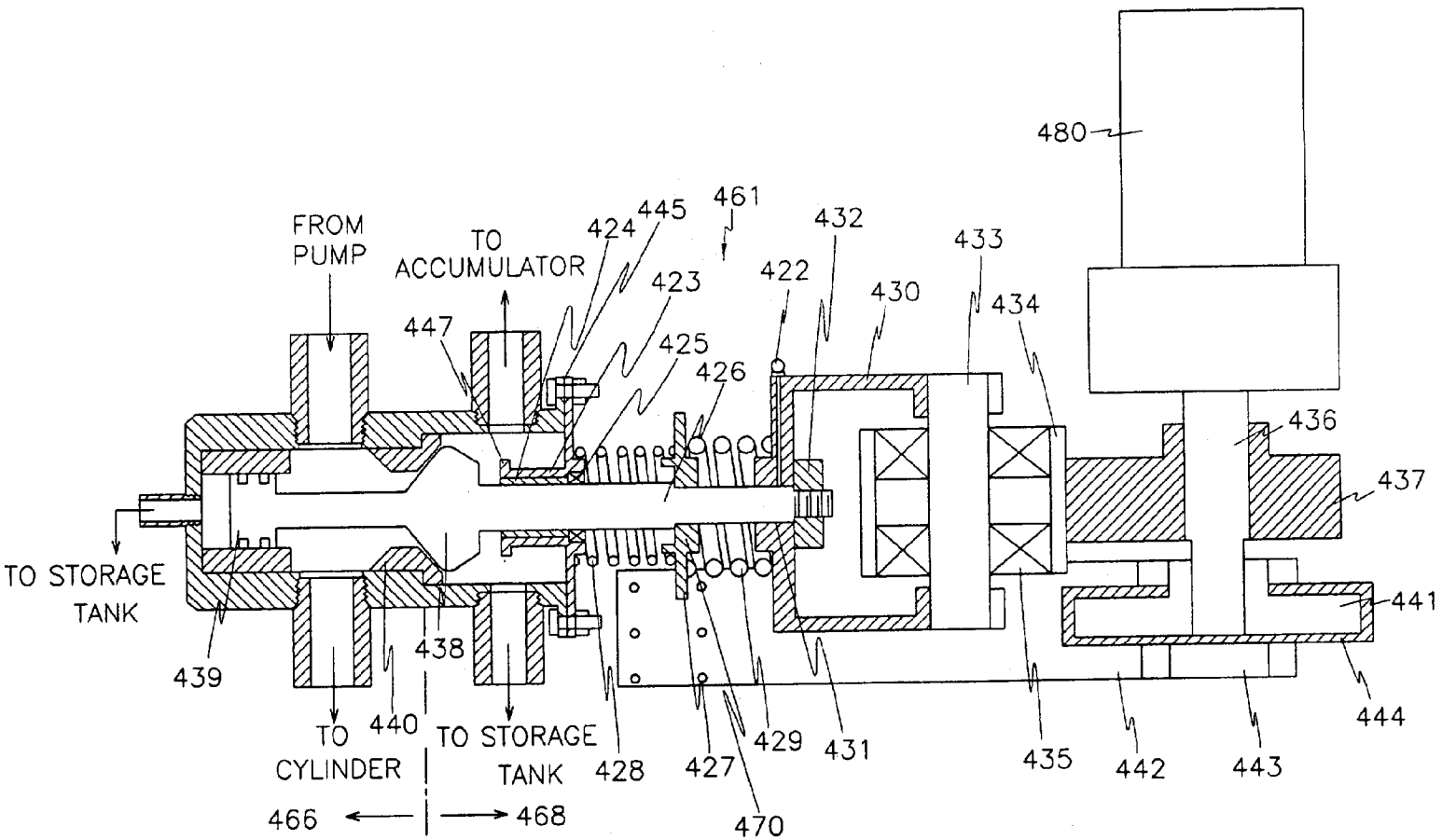
FIG. 23 is a cross sectional view of an hydraulic timing valve and it's driving mechanism of the embodiment of FIG. 20.

FIG. 23 depicts one embodiment of timing valve 461 and its driving mechanism. In this figure valve 461 is of a "poppet type" which has minimal leakage of oil and quick response. However, other type of valves may also be used.

The body of the valve can be divided into high pressure part 466 and low pressure part 468. The low pressure part 468 includes a separable end cover 445 and a short pipe shaped guide 423. Flange 447 is positioned at the inside end of the guide 423 to prevent the poppet 438 from retreating beyond a predetermined position. A guide bushing 424 is fitted inside guide 423 and oil seal 425 is fitted at the outer end of guide 423. Shaft 426 of the poppet 438 is positioned in guide bushing 424 for slide-able reciprocating movement within guide bushing 424 between pre-determined limit defined by flange 447 at one end and poppet seat 440 at the other.

Shaft 426 has annular ledge 470 adjacent one end and spring washer 427 is located adjacent ledge 470.

Spring washer 427 is in contact with two springs, opening spring 428 and closing spring 429. Closing spring 429 is in contact with follower housing 430 at its other end. Follower housing 430 has a guide hole 431 and one end of shaft 426 fits within hole 431. Follower housing 430 is free to slide a short distance on shaft 426. At the end of shaft 426 there is a threaded part and a nut 432 is assembled on it to receive the force of springs 428 and 429. Guide 431 of follower housing 430 is lubricated by grease that is fed by grease nipple 422.

Follower housing 430 includes follower shaft 433 and follower 434. Follower 434 is assembled on follower shaft 433 using two rolling bearings 435. Follower 434 is driven by the cam 437 on shaft 436 of the prime mover 480 such as an electric motor or a hydraulic motor.

The body of valve 461 can be divided into two parts, high pressure part 466 and low pressure part 468 with poppet seat 440 dividing the two parts. When the poppet 438 closes the valve 461, poppet 438 receives a large force equal to the differences of the pressure between the high pressure part 466 and low pressure parts 468.

This large force is compensated by the balance piston 439, so that the opening and closing of hydraulic valve 461 is effected only by the force of springs 428 and 429 and the follower 434.

The closing spring 429 is stronger than the opening spring 428 and when the follower housing 430 pushes the poppet 438 to close the valve 461, only the opening spring 428 is compressed till the poppet 430 is in contact with the poppet seat 440. After the poppet 438 is in contact with the poppet seat 440, the closing spring 429 is compressed as well and the follower housing 430 moves against shaft 426. The distance of movement is adjusted to be small by the shape of cam 437.

The outer periphery of cam 437 is composed of two half circles of different radii which causes the poppet 438 to be in a completely closed or open state.

The valve opening cam 441 is positioned on the shaft of the prime mover to determine the position of the cam 437 and to open the timing valve 461 when the prime mover is stopped. Valve opening cam 441 has an eccentric extension which acts against the elastic force of plate spring 442 and together with follower 444 rotates shaft 436 of the prime mover to open hydraulic valve 461 when the prime mover stops driving the follower 434.

Figure 25:
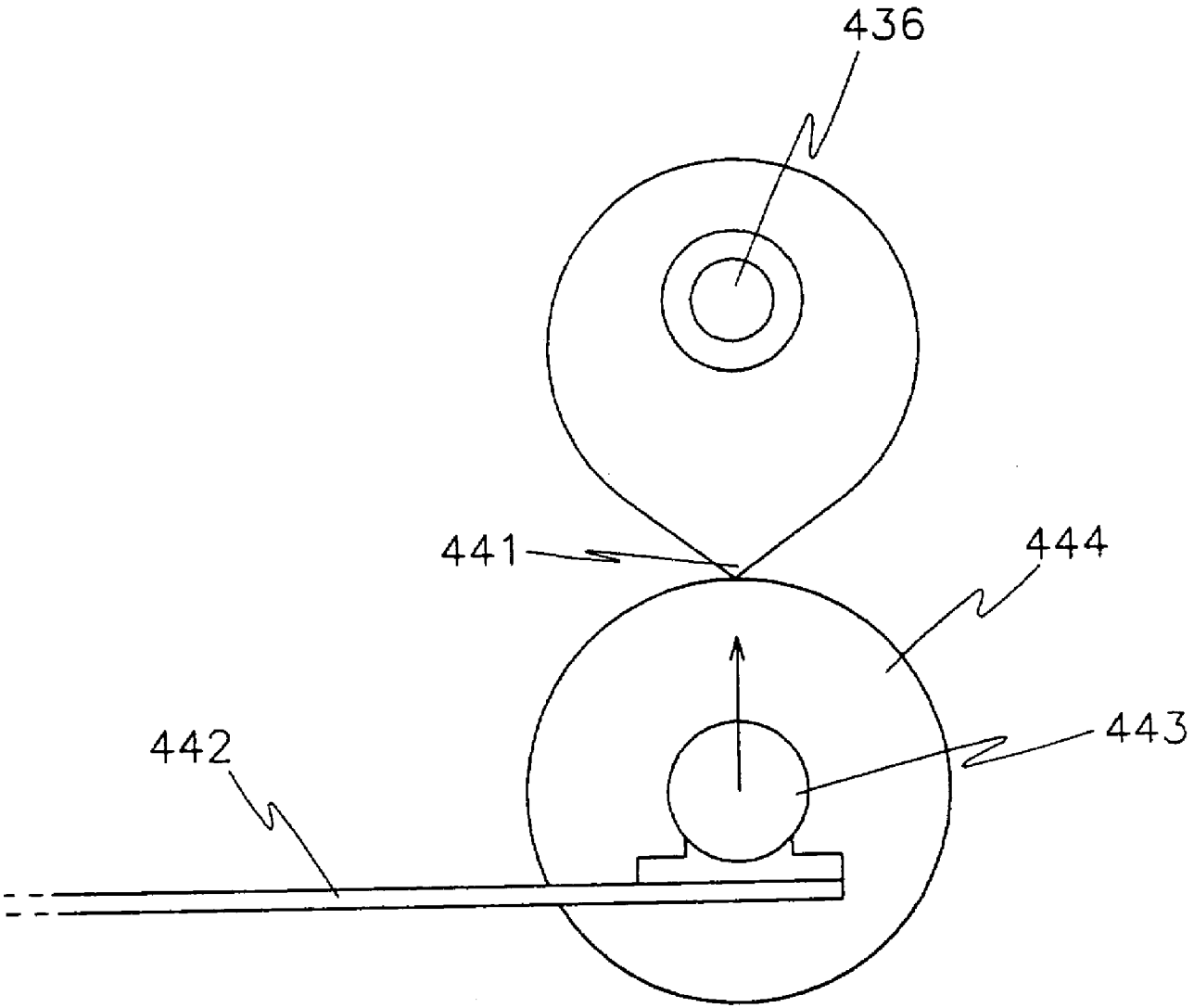
FIG. 25 and FIG. 26 are simplified partially magnified diagrams of hydraulic valve opening cam and follower of the timing valve and driving mechanism of FIG. 23.
Figure 26:
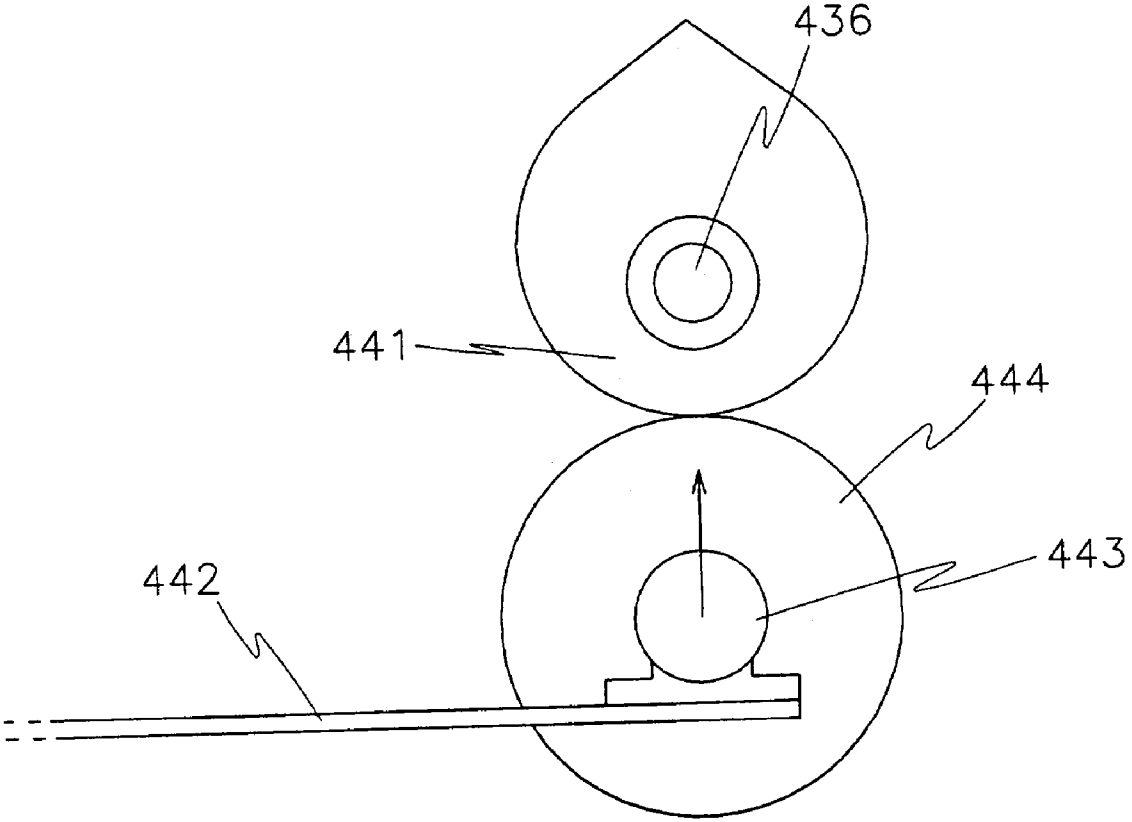

FIG. 25 shows the state of cam 441 when valve 461 is closed. In this state, the follower 444 is driven to its lowest position by the valve opening cam 441. If the prime mover stops driving in this state, the elastic force of the plate spring 442 drives reversibly the shaft of the prime mover 180 degrees through the follower 444 and the valve opening cam 441 to come to rest as depicted in FIG. 26, with timing valve 461 open. Although the prime mover may stop at any other position, the resulting position of the valve opening cam 441 is almost the same and the timing valve 461 is always open when the prime mover stops.

Figure 24:
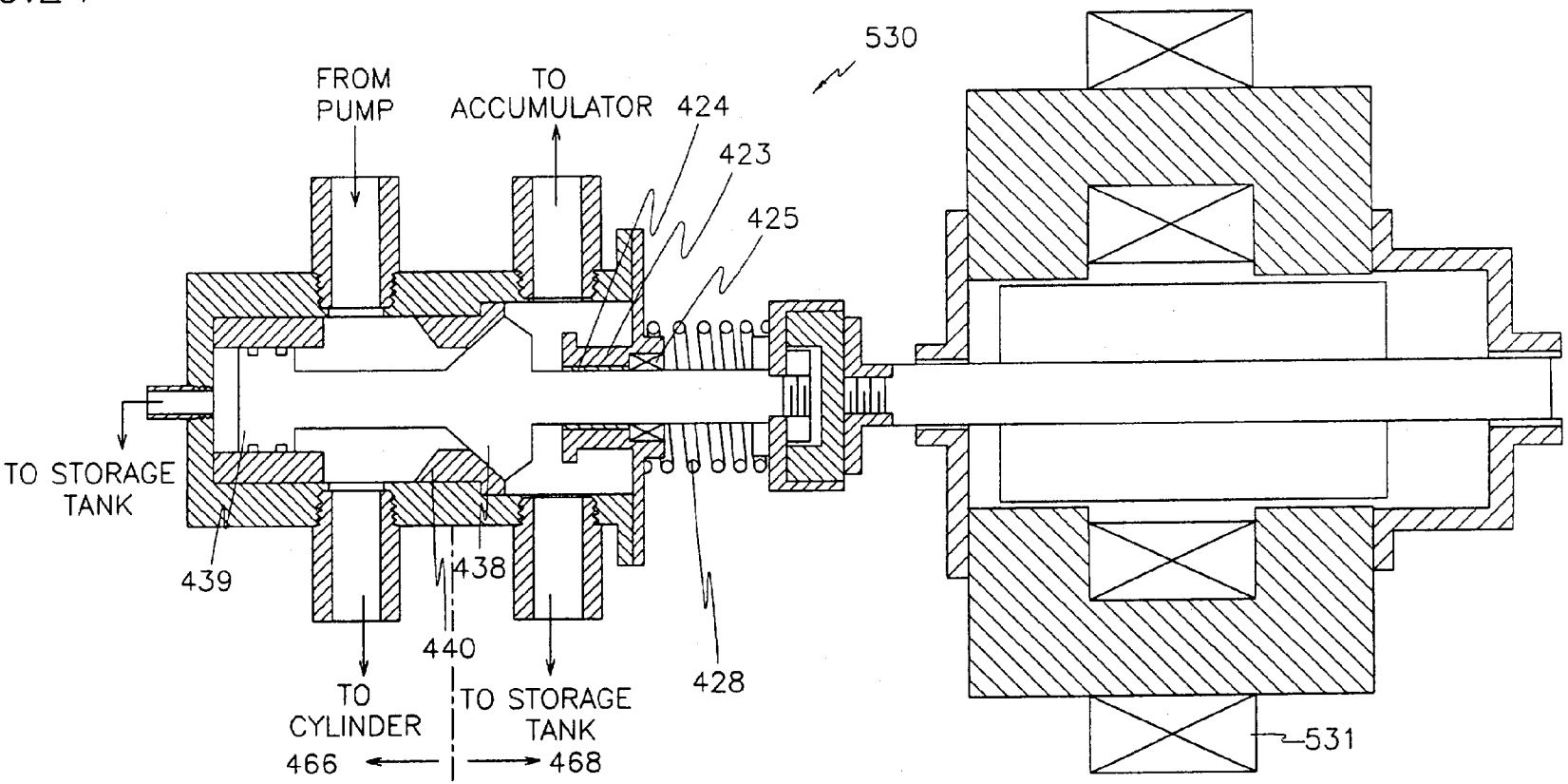
FIG. 24 is a magnified cross sectional view of a solenoid hydraulic valve of the embodiment of FIG. 20.
Figure 27:
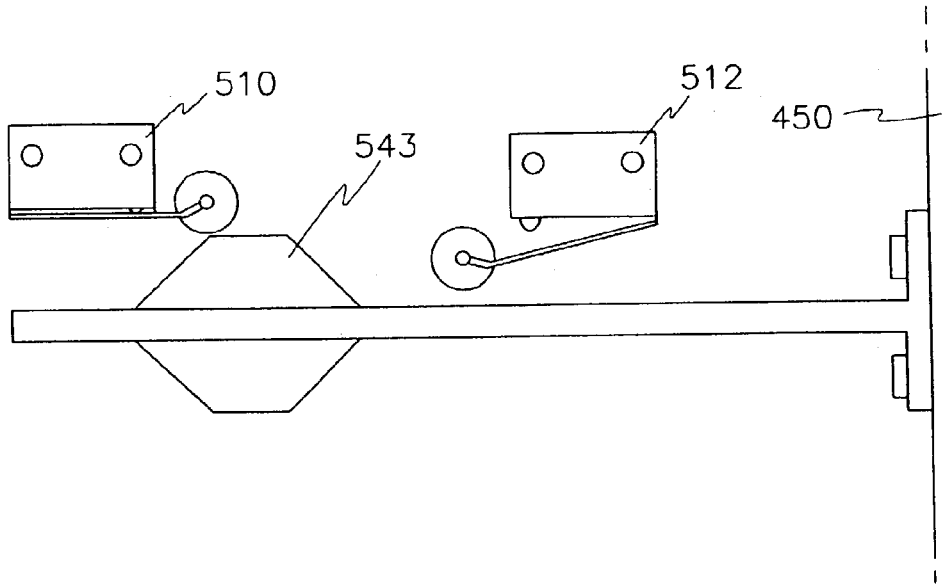
FIG. 27 is a simplified view of electrical sensor switches and cam that is employed in the hydraulic valve of FIG. 24.

FIG. 28 shows an electric circuit to drive a solenoid hydraulic valve 530 and FIG. 24 shows the solenoid hydraulic valve 530 to be used as an alternative to the timing valve 461 of FIG. 23. The hydraulic circuit of FIG. 22 is used with solenoid hydraulic valve 530. FIG. 27 shows the orientation of feedback sensor switches 510 and 512 and lever cam 543 that activates sensor switches 510 and 512 according to the movement of lever 450. Numerical references in FIG. 24 which are the same as the numerical references in FIG. 23 are intended to depict the same elements.

As it's shown in FIG. 27 and FIG. 28, two sensor switches, advance switch 510 and retract switch 512, are connected electrically in series. Advance switch 510 is in open state unless it is touched by lever cam 543 and retract switch is in closed state unless it is touched by lever cam as depicted in FIG. 28. Consequently, when touched by lever cam advance switch 510 causes valve 530 to move lever 450 in a direction toward switch 512 and switch 512 causes valve 530 to move lever 450 in the direction of switch 510. The words, retract and advance are used here according to the state of the movable jaw assembly 24, moving away from (retracting) or moving toward (advancing) stationary jaw assembly 20. The direction of the upper part of lever 450 is opposite to the direction of movement of the movable jaw assembly 24.

Advance switch 510 is positioned to contact the lever cam 543 when the upper part of lever 450 touches stop 415.

Advance switch 510 is connected in parallel to switch terminal 520 of magnetic contactor 522 which drives the solenoid hydraulic valve 530 (FIG. 21) and the switch terminal 520 supplies an alternative bridge of electrical current to magnetic coil 514 when advance switch 510 is open. Magnetic coil 514 closes the switch terminals of magnetic contactor 522 when electric current flows through it. Switch terminal 520 keeps magnetic contactor 522 in its closed state until retract switch 512 is opened by traveling lever cam 543.

The retract switch 512 is always in a closed state in its rest position and the advance switch 510 is always in an open state when it is not actuated by lever cam 543, as depicted in FIG. 27.

Referring to FIG. 24, when the power of the crusher control circuit is off, poppet 438 is pushed back by the force of spring 428 and the hydraulic solenoid valve 530 is in its open state. Lever 450 retracts until the upper part of lever 450 touches stop 415. In this state lever cam 543 touches the follower of advance switch 510 and advance switch 510 is in its closed state.

If electric power is supplied to the control circuit depicted in FIG. 28, electric current flows through the switches 510 and 512 and through magnetic coil 514 and thus magnetic contactor 522 is closed and solenoid 531 of hydraulic valve 530 is powered and hydraulic valve 530 of FIG. 24 is closed.

The driving motor (not shown) of the hydraulic pump 460 of FIG. 22 is always powered before the supply of electric power to the control circuit.

When solenoid hydraulic valve 530 is closed, the hydraulic oil supplied by the hydraulic pump to valve 530 goes to the hydraulic cylinders 401 forcing movable jaw assembly 24 toward stationary jaw assembly 20 to crush rocks 12. The upper part of lever 450 and lever cam 543 move in a direction opposite to the direction of movement of movable jaw assembly 24 and advance switch 510 is opened when cam 543 ceases to actuate switch 510 as cam 543 is moved to a position where it no longer contacts switch 510.

Because switch terminal 520 of magnetic contactor 522 is activated magnetic coil 514 is still supplied with electric current to keep the magnetic contactor 522 in its closed state. This state continues until lever cam 543 touches retracting switch 512 and opens switch 512.

When retract switch 512 is open, the supply of electric current to magnetic coil 514 is cut and magnetic contactor 522 is opened. When magnetic contactor 522 is open, solenoid hydraulic valve 530 is opened by the force of spring 428. Then movable jaw 24 retracts by the force of spring 428 until lever cam 543 contacts and activates the advance switch 510. When lever cam 543 activates advance switch 510 the cycle repeats and jaw crusher 10 crushes rocks 12.

The foregoing describes two types of hydraulic cylinders for driving movable jaw assembly 24, namely an open circuit type and a feedback circuit type. But it should be understood that there are many other variations of hydraulic circuits within the scope of the invention.

I claim:

1. A jaw crusher for crushing hard materials, comprising:

(a) a frame;

(b) a stationary jaw connected to the frame;

(c) a movable jaw positioned spaced in an opposed relationship with the stationary jaw for the receipt of hard materials to be crushed between the jaws, the movable jaw pivotally connected to the frame for pivotal movement about a movable jaw shaft axis with respect to the stationary jaw;

(d) a lever pivotally connected to the frame for pivotal movement about a lever shaft axis, the lever comprising a first extension having a part communicating with the lever shaft and a part communicating with a force transfer device which in turn communicates with the lower back part of the movable jaw to move the movable jaw, and a second extension having a part communicating with the lever shaft and a part communicating with a powered reciprocating drive;

(e) the powered reciprocating drive communicating with the end part of the second extension of the lever to cause cyclic reciprocating movement of the lever about the lever shaft axis for the cyclic supply of crushing power;

(f) the force transfer device delivering the movement of the first extension of the lever to the movable jaw, the lever shaft axis being above the force transfer device; and (g) a biasing device eliminating the unnecessary clearance between the moving parts of the crusher during crushing operation, wherein the first extension of the lever includes a crushed rock size adjusting device, and wherein the crushed rock size adjusting device comprises:

a rectangular paralleled piped housing which has two rectangular openings, one of which is toward the movable jaw and the other of which is on a rear part of an upper face of the housing for the addition or retrieval of adjusting plates and an end wall which has a hydraulic jack access hole;

an adjusting block which is inserted into the housing through the rectangular opening toward the movable jaw for movement and has a toggle seat or a roller seat on the face toward the movable jaw;

the adjusting plates; and hydraulic jack chamber which is attached behind the end wall of the housing.

2. The jaw crusher as described in claim 1, wherein the reciprocating drive comprises:

(a) a powered eccentric shaft which has two separate and concentric outer bearing seats and two inner bearing seats that are located between the two outer bearing seats and concentric to each other and eccentric to the outer bearing seats;

(b) two outer bearings and bearing housings that are connected to the frame for rotational support of the eccentric shaft;

(c) two inner bearings and a tubular housing that are mounted on the inner bearing seats of the eccentric shaft for rotation; and (d) dust seals to prevent dust from entering into the outer and inner bearings.

3. The jaw crusher as described in claim 2, wherein the eccentric shaft is a unitary shaft.

4. The jaw crusher as described in claim 2, wherein the two eccentric bearing seats are made separately from the main shaft and assembled to the main shaft to form a sectional eccentric shaft.

5. The jaw crusher as described in claim 1, wherein the reciprocating drive comprises:

(a) a pipe which is connected to the frame and has several holes and flanges to insert and support a same number of hydraulic cylinders and has one or more lever stoppers made of elastic materials;

(b) a same number of hydraulic cylinder assemblies to the number of the flanges on the pipe; and (c) a hydraulic circuit to drive the hydraulic cylinders for reciprocal movement.

6. The jaw crusher as described in claim 5, wherein each hydraulic cylinder assembly comprises:

(a) a tubular cylinder body which has a flange on one end and an end cap with an oil pipe on the other end;

(b) a hard cylinder liner which protects the inner surface of the cylinder body;

(c) a piston which has several piston rings and a half sphere groove on the center of the outer surface of the piston;

(d) a piston rod with two assembled spherical ends;

(e) a short pipe which is connected to a circular hole on the upper end part of the lever and is capped by a washer shaped flange;

(f) a piston rod seat which is placed in the short pipe of the lever and connected to the washer shaped flange by bolts; and (g) a cone shaped rubber membrane with a drain pipe, one end of the cone shaped rubber membrane connected to a rubber membrane flange and the other end of the cone shaped rubber membrane connected to an end part of a piston rod adjacent to the piston rod seat.

7. The jaw crusher described in claim 5, wherein the hydraulic circuit comprises:

(a) a hydraulic oil tank;

(b) a hydraulic pump to supply high pressure hydraulic oil to cylinders;

(c) a timing valve to control the flow of the returning hydraulic oil from the cylinders to the hydraulic tank; and (d) a relief valve to relieve the abnormal high pressure in returning pipe to the tank.

8. The jaw crusher as described in claim 7, wherein control of the timing valve is of an open circuit type.

9. The jaw crusher as described in claim 7, wherein control of the timing valve is of a feedback circuit type.

10. The jaw crusher as described in claim 1, wherein the force transfer device comprises a toggle plate and two toggle seats, one of which is attached to the lower back part of the movable jaw and the other of which is attached to a face of an adjusting block toward the movable jaw, said adjusting block positioned within a portion of said first extension part.

11. The jaw crusher as described in claim 1, wherein the force transfer device comprises:

(a) a movable jaw force transfer plate, one end of which is fixed to the lower part of the movable jaw back plate and the other end of which has a head with a heat treated hard roller seat;

(b) a roller;

(c) an adjusting block roller seat which is placed on the face of the adjusting block toward the movable jaw; and (d) a roller support flange which is fixed to one of the lower edge of the head of the movable jaw force transfer plate and the lower edge of the adjusting block.

12. The jaw crusher as described in claim 1, wherein a movable jaw shaft is fixed to one of the upper end of the movable jaw and the frame, movable jaw shaft bearings attached to the other of the movable jaw and the frame, and the movable jaw shaft and the movable jaw shaft bearings rotatably connected together.

13. The jaw crusher as described in claim 12, wherein the bearings are attached to the frame, each bearing comprising:

(a) two parallel walls that are perpendicularly attached to side walls of the jaw crusher and slanted according to the angle of a movable jaw inner face and a base plate which is perpendicular to the two parallel walls to make a channel shaped bearing cavity for the shaft;

(b) hard heat treated replaceable bearing linings to cover three inner surfaces of bearing faces; and (c) a side cover plate to prevent the movement of the shaft along the axis of the shaft.

14. The jaw crusher as described in claim 12, wherein the bearings are attached to the movable jaw and the lever, each bearing comprising:

(a) two parallel walls slanted according to the angle of a movable jaw inner face and a ceiling plate which is perpendicular to the two parallel walls to make a reversed channel shaped bearing cavity for the shaft; and (b) hard heat treated replaceable bearing linings to cover three inner surfaces of bearing faces.

15. The jaw crusher as described in claim 12, wherein the bearings are journal bearings and are attached to the movable jaw and the lever.

16. The jaw crusher as described in claim 1, wherein the lever shaft is fixed to one of the lever and the frame, lever shaft bearings attached to the other of the lever and the frame, and the lever shaft and the lever shaft bearings rotatably connected together.

17. The jaw crusher as described in claim 1, wherein the movable jaw is rotatably connected to the frame by a single roller bearing, the single roller bearing comprising:

(a) an angle shaped movable jaw hanger which is fixed to the upper end of the movable jaw and has a vertical or a slanted vertical wall and a ceiling flange that extends toward the lever, the vertical or slanted vertical wall and the ceiling flange perpendicular to each other;

(b) a movable jaw support plate which is fixed to the upper part of the frame and has an angle shaped head at the end toward the stationary jaw, the angle shaped head having a base flange extended toward the moveable jaw and a vertical or a slanted vertical face that is perpendicular to the base flange;

(c) replaceable linings that cover inner surfaces of the movable jaw hanger and a head of the movable jaw support plate; and (d) a cylindrical long roller which is placed between the angle shaped replaceable movable jaw angle and head linings of the movable jaw support plate.

18. The jaw crusher as described in claim 1, wherein the lever is rotatably connected to the frame by a single roller bearing, the single roller bearing comprising:

(a) a replaceable lever angle which is fixed to the lever and has a vertical or a slanted vertical wall and a ceiling flange extended toward the back of the crusher, the vertical or a slanted vertical wall and the ceiling flange perpendicular to each other;

(b) a lever support plate which is fixed to the lower back part of the frame and has an angle shaped head at the end toward the movable jaw, the angle shaped head having a base flange extended toward the movable jaw and a vertical or a slanted vertical face that is perpendicular to the base flange;

(c) replaceable linings that cover the inner faces of the lever angle and the head of the lever support plate; and (d) a cylindrical long roller which is placed between the linings of the lever angle and the head of the lever support plate.

19. The jaw crusher as described in claim 1, wherein the biasing device has one or more movable jaw biasing units, each biasing unit comprising:

(a) a hinge plate with a hole which is fixed to a lower back part of the movable jaw;

(b) a tension rod which has hinge plates with holes fixed at one end and a threaded end part on the other end;

(c) a hinge pin to connect the hinge plates fixed to the movable jaw and the tension rod;

(d) a bracket with a spring seat and a hole for the passage of the tension rod, which is fixed on a lower back part of the frame facing the hinge plate of the movable jaw;

(e) a tension spring; and (f) a washer spring seat and a nut that fits the threaded end part of the tension rod for the compression of the tension spring.

20. The jaw crusher as described in claim 19, further comprising one or more lever biasing units and each biasing unit comprising:

(a) a latch which is attached to the middle part of the back plate of the movable jaw;

(b) a tension rod which has a hook on one end and a threaded end part on the other end;

(c) a hole on an upper part of the lever for passage of the tension rod, and a spring seat attached to the lever behind the hole;

(d) a tension spring; and (e) a washer spring seat and a nut for the compression of the tension spring.

21. The jaw crusher as described in claim 19, further comprising one or more movable jaw upper biasing units and each biasing unit comprising:

(a) a hinge plate with a hinge hole which is fixed to an upper end part of the movable jaw;

(b) a tension rod which has hinge plates with holes fixed at one end and a threaded end part on the other end;

(c) a hinge pin to connect the hinge plates fixed to the movable jaw and to the tension rod;

(d) a bracket with a spring seat and a hole for the passage of the tension rod, which is fixed on an upper part of the frame facing the hinge plate of the movable jaw;

(e) a tension spring; and (f) a washer spring seat and a nut that fits the threaded end part of the tension rod for the compression of the tension spring.

22. The jaw crusher as described in claim 19, further comprising one or more lever weight compensation biasing units, each biasing unit comprising:

(a) a hinge plate with a hinge hole which is fixed to the back plate of lever;

(b) a tension rod which has a hinge plate or plates with a hinge hole or holes fixed at one end of it and a threaded end part at the other end;

(c) a hinge pin to connect the hinge plates of the lever and the tension rod;

(d) a bracket with a spring seat and a hole for the passage of the tension rod, fixed on an upper rear part of upper frame facing the hinge plate of the lever;

(e) a tension spring; and (f) a washer spring seat and a nut that fits the threaded end part of the tension rod for the compression of the tension spring.

* * * * *